United States Patent [19]

Baier et al.

[11] 4,324,233

[45] Apr. 13, 1982

[54] FEED ARRANGEMENT FOR AND METHOD OF CONTINUOUSLY FEEDING CIGARS WRAPPERS TO CIGAR WRAPPING STATIONS OF CIGAR WRAPPING MACHINES

[75] Inventors: Robert J. Baier, West Chester; Edward W. Glatfelter, Newtown Square, both of Pa.

[73] Assignee: Gulf & Western Corporation, New York, N.Y.

[21] Appl. No.: 148,924

[22] Filed: May 12, 1980

Related U.S. Application Data

[63] Continuation of Ser. No. 973,037, Dec. 26, 1978, abandoned.

[51] Int. Cl.[3] ..... A24C 1/28

[52] U.S. Cl. ..... 128/58; 128/37; 128/105

[58] Field of Search ..... 131/58, 34, 35, 37, 131/38, 69, 90, 105, 26, 27; 53/211, 214

[56] References Cited

U.S. PATENT DOCUMENTS

| | | | |
|---|---|---|---|
| 693,626 | 2/1902 | Schneekloth . | |
| 829,619 | 8/1906 | Knight . | |
| 2,601,856 | 7/1952 | Giles | 131/105 X |
| 2,608,974 | 9/1952 | Ferenci | 131/105 |
| 2,963,025 | 12/1960 | Skarstrom | 131/52 |
| 3,105,497 | 10/1963 | Petri et al. | 131/105 X |
| 3,111,950 | 11/1963 | Verbakel | 131/8 |
| 3,340,878 | 9/1967 | Pallach et al. | 131/105 |
| 3,794,048 | 2/1974 | Molins | 131/94 |
| 4,103,692 | 8/1978 | Baier et al. | 131/32 |

FOREIGN PATENT DOCUMENTS

| | | | |
|---|---|---|---|
| 662087 | 3/1935 | Fed. Rep. of Germany . | |
| 1432681 | 4/1970 | Fed. Rep. of Germany . | |
| 1018320 | 1/1953 | France . | |
| 108960 | 6/1964 | Netherlands | 131/105 |

*Primary Examiner*—Stephen C. Pellegrino
*Attorney, Agent, or Firm*—Meyer, Tilberry & Body

[57] ABSTRACT

A respacer and/or reorienter feed arrangement is operative for continuously feeding cigar wrappers in proper spaced-apart relationship and/or orientation to a cigar wrapping station of a multi-station cigar wrapping machine which includes a cigar bunch supply station, a cigar wrapper supply station, and a conveyor for conveying the bunches to a cigar wrapping station at which the wrappers are spirally applied about the bunches. The method of respacing and/or reorienting the wrappers includes conveying the latter in a predetermined arranged relationship and/or orientation in which successive wrappers are located relative to one another at positions selected for optimum compact transport purposes, and continuously moving each successively leading wrapper, one after another, relative to its next successively trailing wrapper, from its respective optimum compact transport position to and through the cigar wrapping station. The wrappers are conveyed through the wrapping station in another different arranged relationship in which successive wrappers are located relative to each other at different positions selected for optimum wrapping purposes. Cigar wrapping is performed in an automatic, non-stop manner.

5 Claims, 25 Drawing Figures

P'
P'
20
20
19
19
310
311
317
318
320
322
324
326
328
330a
330b
330c
330d
332
334
336
337
338
339
343
350
352
353
360a
360b
360c
360d
362
305
305'
353'
343'
390a
390b
390c
390d
390a'
390b'
390c'
390d'
390a"
390b'
390c"
390d"
330a'
330b'
330c'
330d'

FIG. 18
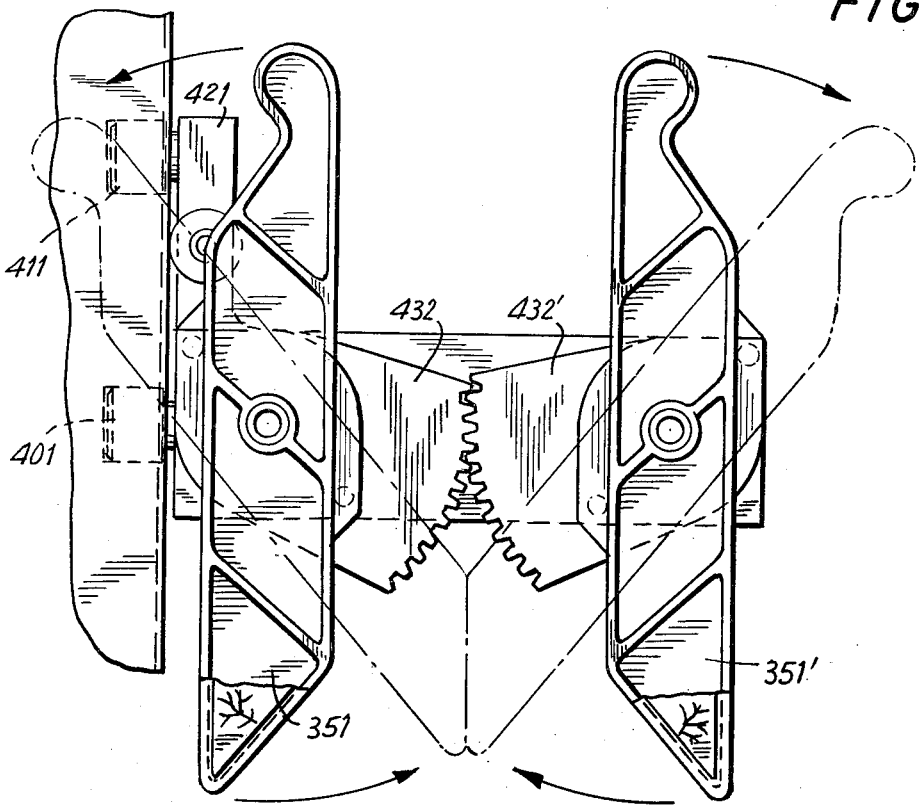
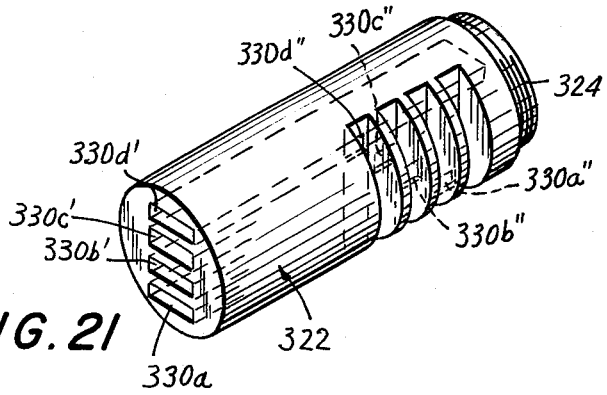
FIG. 21
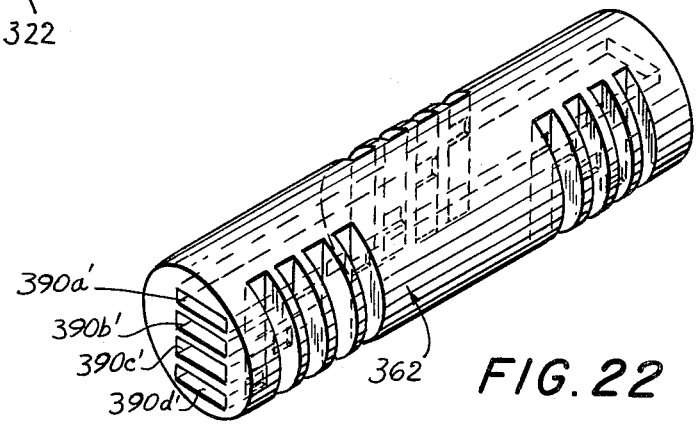
FIG. 22

FEED ARRANGEMENT FOR AND METHOD OF CONTINUOUSLY FEEDING CIGARS WRAPPERS TO CIGAR WRAPPING STATIONS OF CIGAR WRAPPING MACHINES

This is a continuation of application Ser. No. 973,037 filed Dec. 26, 1978 now abandoned.

BACKGROUND OF THE INVENTION

1. Field of the Invention

The present invention generally relates to multistation cigar wrapping machinery having a cigar bunch supply station, a cigar wrapper supply station, and a conveyor for conveying the bunches to a cigar wrapping station at which the wrappers are spirally applied about the bunches. More particularly, the present invention relates to respacer and/or reorienter feed arrangements for and methods of continuously feeding cigar wrappers in proper spaced-apart relationship and/or orientation to the wrapping stations of such machinery.

2. Description of the Prior Art

It has been proposed in the field of commercial cigar wrapping machinery to feed wrappers to a wrapping station in an intermittent, semi-automatic manner. The wrappers are thus repeatedly stopped and thereupon restarted during their transport to the wrapping station at which they are spirally applied about the bunches. The start-and-stop motion of the wrapper stock is inefficient, time-consuming, and has restricted production output rates to relatively low values, typically on the order of twenty wrapped cigars per minute.

It has further been proposed in this field to feed wrappers in a more continuous manner to the wrapping station. However, this proposal requires that alternate wrappers be picked off the wrapper conveyor. See U.S. Pat. No. 4,103,692, FIG. 35, which issued on a copending application owned by a common assignee. Put another way, rather than selecting the time at which a wrapper arrives at the wrapping station, as taught by the first mentioned prior art proposal, the second mentioned proposal selects which wrapper would arrive at the wrapping station at the appropriate time. Although the latter proposal is generally satisfactory for its intended purpose, each wrapper is not handled in its turn, thereby resulting in production inefficiency. This means that the non-selected wrappers must be handled, if at all, at another downstream wrapping station. The provision of multiple wrapping stations results, of course, in added production costs.

SUMMARY OF THE INVENTION

Objects of the Invention

Accordingly, it is the general object of the present invention to overcome the above described drawbacks of the prior art.

It is a further object of the present invention to increase production efficiency by rendering the feeding operation of the cigar wrappers to the wrapping station fully automatic, continuous and non-stop.

Still a further object of the present invention is to increase production efficiency by handling each successively leading wrapper in its turn.

It is an object of the present invention to obtain higher speeds of production and to reduce the costs of manufacturing wrapped cigars.

It is an additional object of the present invention to supply wrappers to the wrapper supply station at a predetermined spaced-apart relationship and predetermined relative orientation selected for optimum compact transport purposes.

Yet another object of the present invention is to convey wrappers through the wrapping station at a different spaced-apart relationship selected for optimum wrapping purposes.

A further object of the present invention is to respace the wrappers from said predetermined spaced-apart relationship to said different spaced-apart relationship in an efficient, smooth, fluid, continuous and reliable manner.

Still a further object of the present invention is to reorient the wrappers from said predetermined relative orientation to said different relative orientation in an efficient, smooth, fluid, continuous and reliable manner.

It is an object of the present invention to simultaneously respace and reorient the wrappers from said predetermined spaced-apart relationship and relative orientation to said different spaced-apart relationship and relative orientation.

Another object of the present invention is to maintain the relative spacing between the wrappers during their passage through the cigar wrapping station substantially constant.

Yet another object of the present invention is to reliably pickup each successively leading wrapper in its turn by suction and to reliably release each such suction-held wrapper in a gradual lengthwise manner as the respective wrapper enters and passes through the wrapping station.

Brief Description of the Invention

In keeping with these objects and others which will become apparent hereinafter, one feature of the invention resides, briefly stated, in an improved feed arrangement for and method of continuously feeding cigar wrappers to a cigar wrapping station of a multi-station cigar wrapping machine. The machine includes a cigar wrapper supply station for supplying cigar wrappers; conveyor means for continuously and sequentially conveying a series of cigar wrappers, one after another, along a wrapper transport path to the wrapper supply station, said wrappers being conveyed along the wrapper transport path in a predetermined arranged relationship in which successive wrappers are located relative to one another at positions selected for optimum compact transport purposes; a cigar bunch supply station for supplying cigar bunches; means for continuously and sequentially conveying a series of cigar bunches, one after another, from the bunch supply station along a bunch feed path towards the cigar wrapping station; and means at the cigar wrapping station for spirally applying wrappers from the wrapper supply station about the bunches to thereby form spirally wrapped cigars.

In accordance with the invention, the feed arrangement and method includes continuously and sequentially moving each successively leading wrapper, one after another, relative to its next successively trailing wrapper, from its respective optimum compact transport position along a wrapper feed path and through the cigar wrapping station. The wrappers are conveyed along the wrapper feed path through the cigar wrapping station in another different arranged relationship in which successive wrappers are located relative to one another at different positions selected for optimum wrapping purposes. In this manner, each successively leading wrapper on the wrapper feed path registers with each successively leading bunch on the bunch feed path at the cigar wrapping station at substantially the same time. Thus, cigar wrapping is performed in an automatic and non-stop manner.

By moving each successively leading wrapper, one after another, in a continuous manner, the above mentioned prior art drawbacks associated with feeding wrappers in a start-and-stop manner and of selecting wrappers out of turn in a non-sequential manner have been overcome. Higher production rates and lower manufacturing costs are, therefore, attained. The moving means is operative to respace each successively leading wrapper from its respective optimum compact transport position, in which it is spaced at a first distance relative to the next successively trailing wrapper, to the respective optimum wrapping position, in which it is spaced at a different second distance relative to the next successively trailing wrapper. In accordance with one embodiment of the invention, the second distance is greater than the first distance. In accordance with another embodiment of the invention, the second distance is smaller than the first distance.

The moving means is also operative to reorient each successively leading wrapper from its respective optimum compact transport position, in which it is oriented at a first orientation relative to the next successively trailing wrapper, to the respective optimum wrapping position, in which it is oriented at a different second orientation relative to the next successively trailing wrapper. In accordance with a preferred embodiment of the invention, the wrappers are oriented in end-to-end alignment in said first orientation, and are oriented in a generally V-shaped chevron-type alignment in said second reorientation.

Of course, the respacing and reorienting aspects of the moving means may be performed either separately or simultaneously, as desired.

In accordance with yet another feature of the invention, the spacing between wrappers as they pass through the wrapping station, is maintained essentially constant and uniform. This feature assures that the wrapping of a wrapper about a bunch will be performed in a continuous, smooth, fluid, automatic, uniform manner.

In accordance with still another feature of the invention, each wrapper is reliably picked up in its turn, by suction at the wrapper supply station and conveyed towards the wrapping station. Each successively leading wrapper is thereupon reliably released in a continuous, gradual, uniform manner lengthwise along each wrapper as the latter enters and passes through the wrapping station.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 18 is an enlarged, top plan view as taken on line 18—18 of FIG. 16, and diagrammatically showing the wrapper platens in two different positions;

FIG. 21 is an enlarged, perspective view of a detail of FIG. 16;

FIG. 22 is an enlarged, perspective view of another detail of FIG. 16;

DETAILED DESCRIPTION OF THE PREFERRED EMBODIMENTS

General Considerations for All Embodiments

Figure 23:
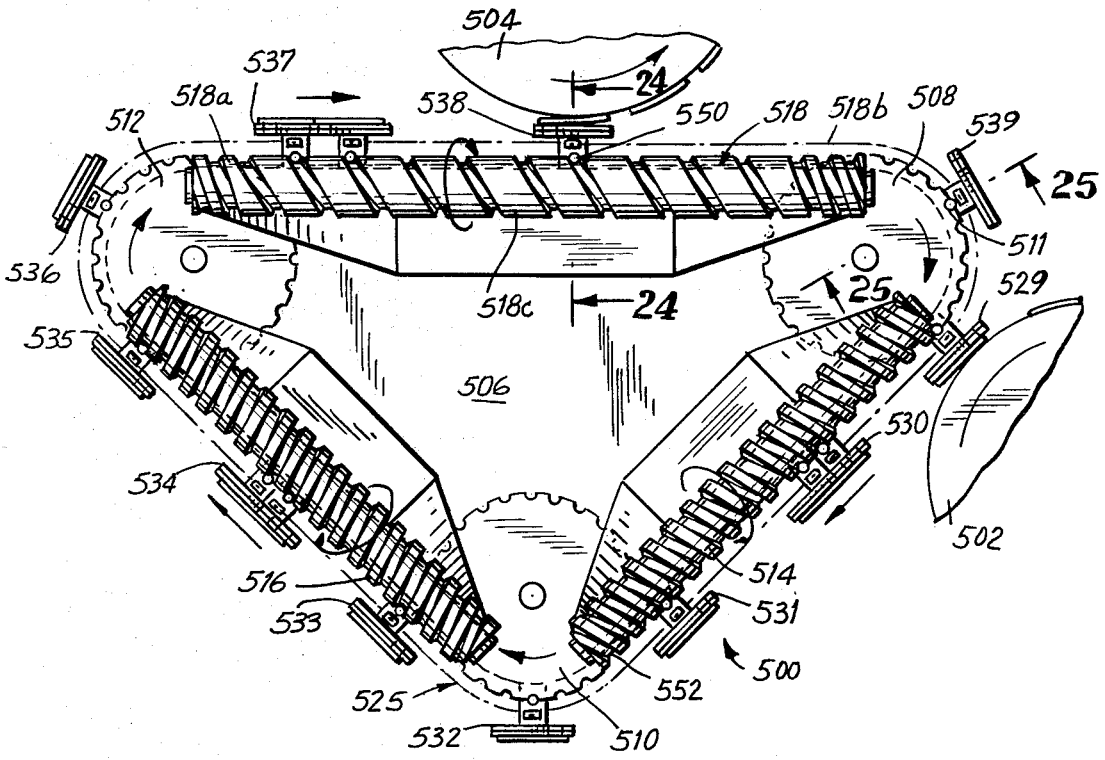
FIG. 23 is a partially broken-away, partially diagrammatic front view of a third embodiment of a feed arrangement in accordance with the present invention.
Figure 24:
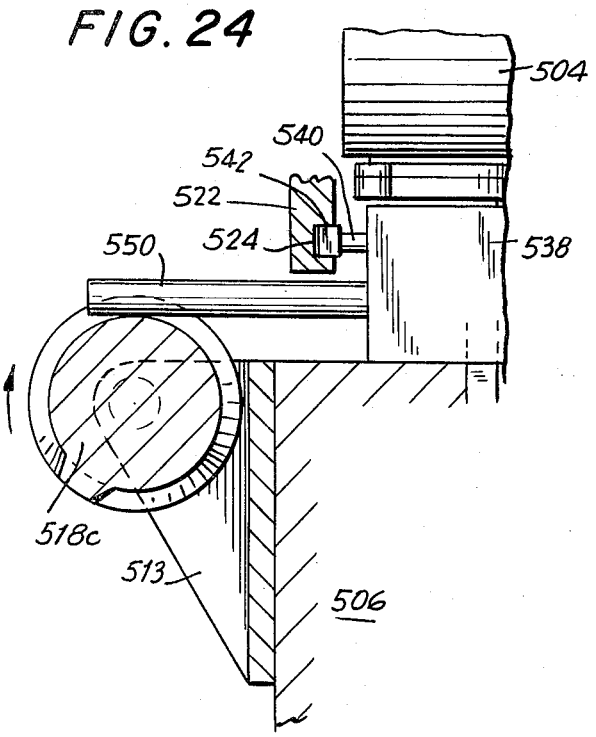
FIG. 24 is an enlarged, partially sectioned view as taken on line 24—24 of FIG. 23.
Figure 25:
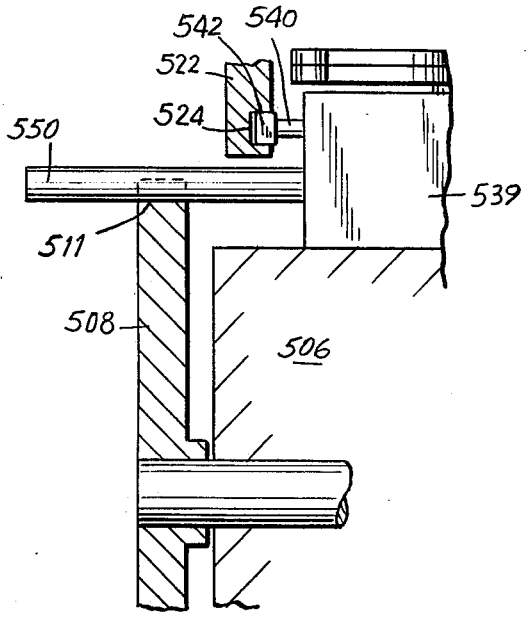
FIG. 25 is an enlarged, partially sectioned view as taken on line 25—25 of FIG. 23.

Referring now to the drawings, FIGS. 1–15 illustrate one preferred embodiment of an improved feed arrangement for and method of continuously feeding cigar wrappers to a cigar wrapping station of a multi-station cigar wrapping machine; FIGS. 16–22 illustrate another preferred embodiment; and FIGS. 23–25 illustrate yet another preferred embodiment.

The wrappers may be initially supplied to the wrapping machine in many forms. For example, the wrappers may be individually pre-cut natural tobacco material, each wrapper being oriented and placed on a carrier tape for optimum utilization of the tape, e.g. for compact transport purposes. Alternatively, the wrappers may be supplied as a strip sheet of reconstituted tobacco, the makeup of such sheet being well known in the art. A typical sheet may include particulate natural tobacco which has been attrited from natural leaf material and embedded in a matrix of smokable material, or the sheet may constituted by pieces of natural tobacco glued or cemented end-to-end. Reconstituted tobacco is preferred if the same is acceptable for a finished cigar, as it conventionally is for inexpensive cigars inasmuch as wrappers of reconstituted tobacco are uniform in consistency, strength, dimension and appearance, thereby making it easier to design a machine to handle such wrappers in high speed mass production as compared to wrapper sheets made up of joined or carried pieces of natural tobacco. In the sheet form, i.e. without a carrier tape, the sheet must be conveyed to and past a rotary cutter or the like, to thereby cut the wrappers to the appropriate shape necessary for wrapping cigar bunches.

Figure 3:
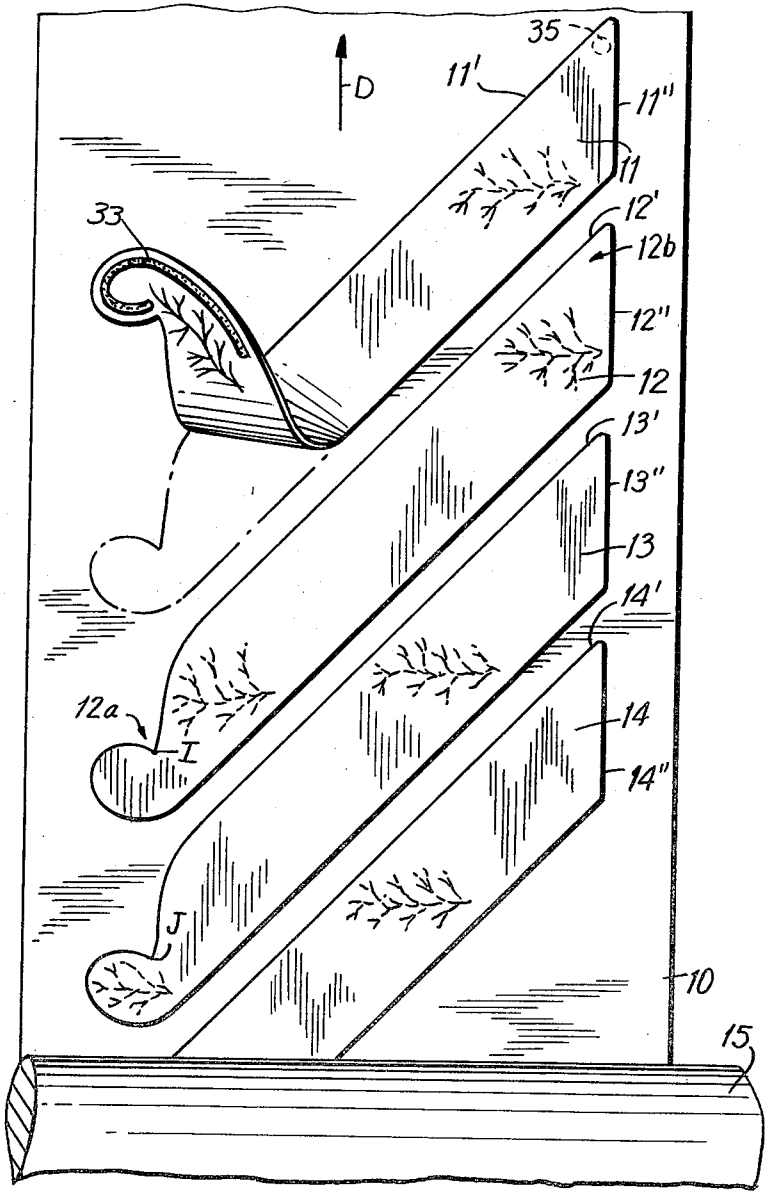
FIG. 3 is a greatly enlarged, top plan view of individual cigar wrappers mounted in spaced relationship on a carrier tape, and diagrammatically shows one wrapper end lifted up to expose an adhesive strip on its underside.

As described in greater detail below, FIG. 3 shows a plurality of wrappers 11, 12, 13, 14 mounted on a carrier tape or strip 10 which is elongated in direction of arrow D and which is unwound from supply roll 15. The wrappers are inclined relative to the elongation and direction of movement of the strip 10. FIG. 3 shows the preferred manner of supplying wrappers for the embodiment of FIGS. 1–15. If the individual wrappers were arranged relative to each other in end-to-end alignment on a carrier tape rather than the side-by-side alignment of FIG. 3, then this would be the preferred manner of supplying wrappers for embodiments of FIGS. 16–22 and of FIGS. 23–25. Of course, as noted above, the wrappers need not be pre-cut and carried on a tape, but may equally be supplied in sheet form to a conventional rotary cutter for pre-cutting for any of the aforementioned embodiments.

Wrapper Delivery to Cigar Wrapper Stations (FIGS. 1–15)

Figure 1:
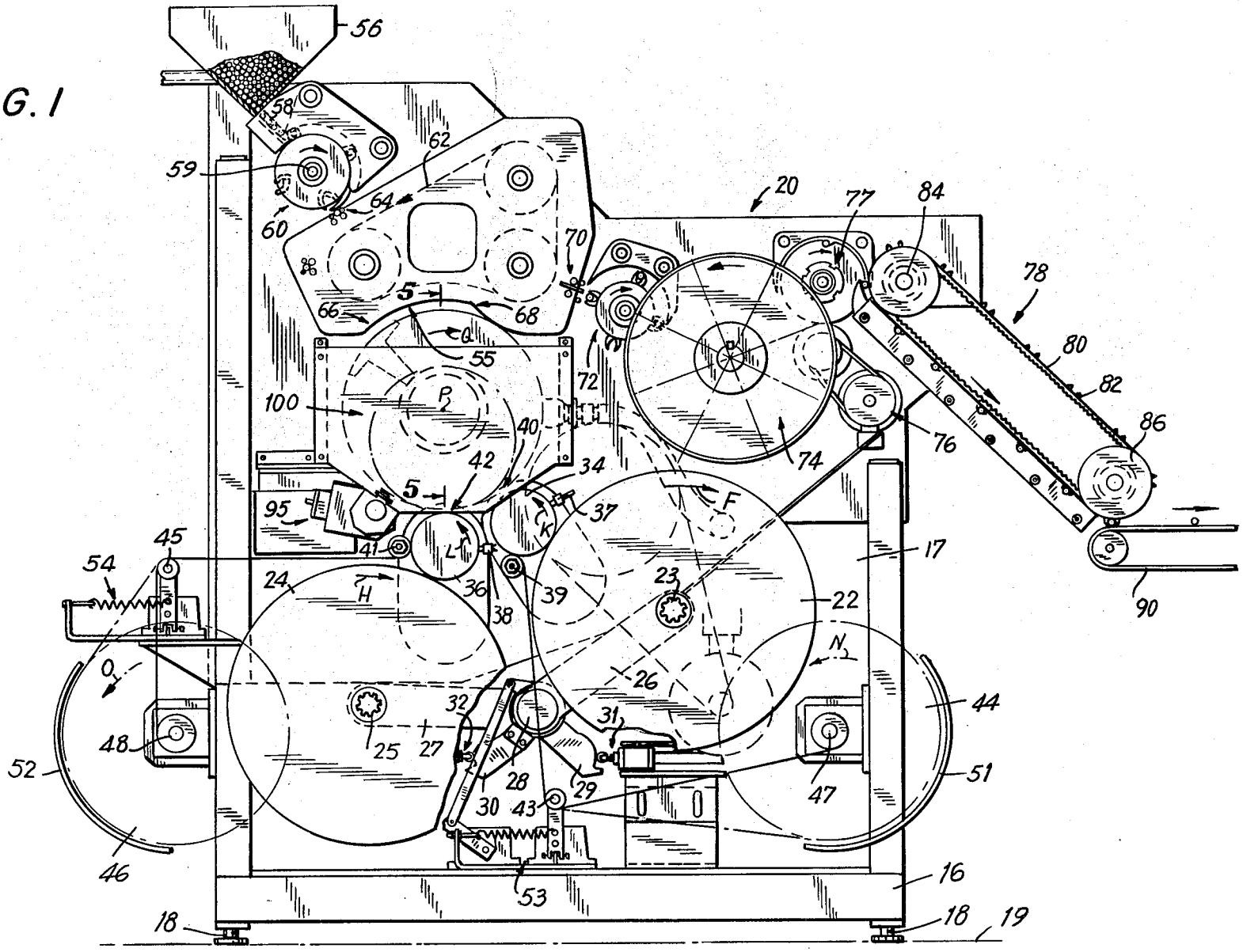
FIG. 1 is a partially broken-away, partially diagrammatic, front elevational view of a cigar wrapping machine on which a first embodiment of a feed arrangement is mounted in accordance with the present invention.
Figure 2:
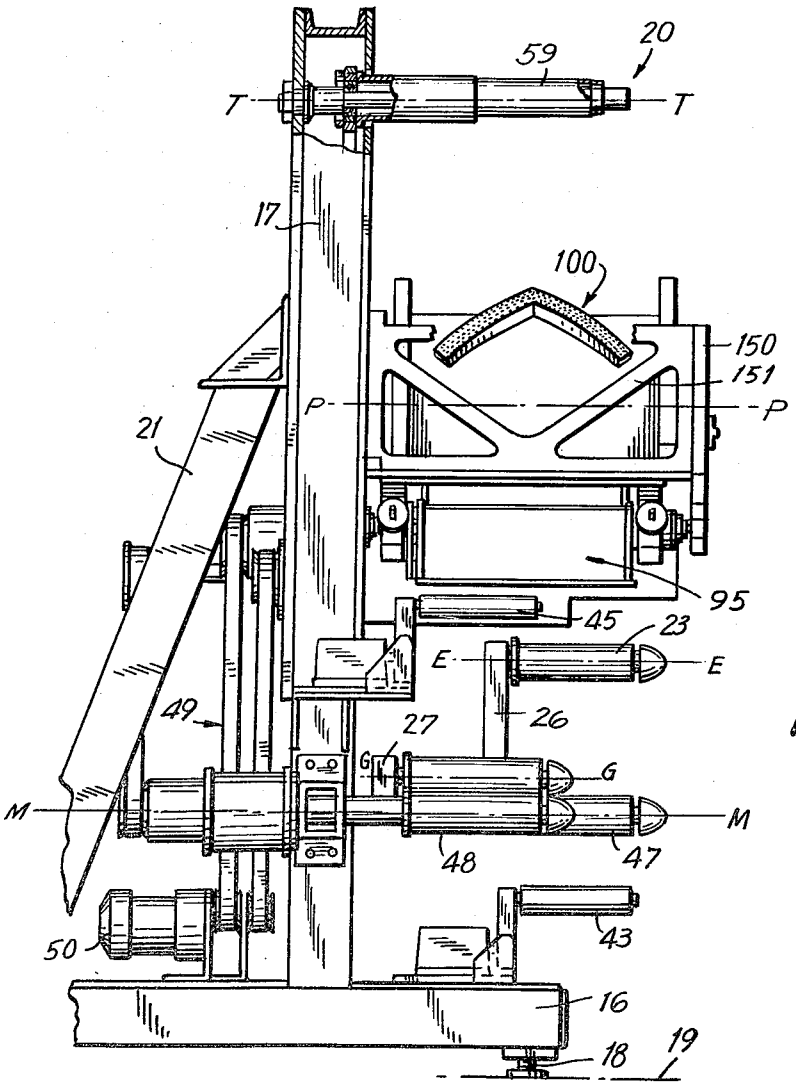
FIG. 2 is a partially broken-away, partially diagrammatic, side elevational view of the cigar wrapping machine and feed arrangement of FIG. 1.

Referring now in detail to FIGS. 1 and 2, reference numeral 20 generally identifies a cigar wrapping machine comprised of a frame and a plurality of work stations mounted thereon. The frame includes a horizontal mounting plate 16 having height-adjusting feet 18 mounted on the floor 19, a vertical mounting plate 17 connected to the horizontal plate 16, and a pair of inclined reinforcement struts 21 connected to both plates to support the vertical plate 17 in a generally upright orientation.

First or right hand wrapper feed reel 22 is mounted on shaft 23 for rotation about axis E—E in circumferential direction of arrow F. Second or left hand wrapper feed reel 24 is mounted on shaft 25 for rotation about axis G—G in circumferential direction of arrow H. A roll 15 (see FIG. 3) is mounted in coiled form on each reel.

Links 26, 27 respectively mount right feed reel 22 and left feed reel 24 for limited angular pivotal movement about stub shaft 28. Control links 29, 30 each have cam surfaces which cooperate with cam follower units 31, 32 which are operative to constantly urge the leading strips 10 on both the right and left feed reels 22, 24 into affirmative engagement with the respective peripheral surfaces of right hand transfer roller 34 and left hand transfer roller 36.

Turning now to FIG. 3, the pre-cut wrappers 11, 12, 13, 14, as noted above, are mounted on carrier strip 10 which is unwound from the roll 15 in direction of arrow D. The wrappers are elongated and oriented at an angle of inclination on the order of 45° relative to the direction of advancement. Each wrapper has a leading or tuck end region and a trailing or flag end region. For example, wrapper 12 has flag end region 12*a* which first converges in direction away from tuck region 12*b*, and then terminates in a curlicue having a generally circular outline. Also, the shape of the flags is not unique to the present invention because it has been used before in conjunction with semi-automatic equipment.

Tuck end region 12*b* tapers to an apex which is bounded by edges 12′, 12″. It will be noted that edges 11″, 12″, 13″, 14″ are colinear and that edges 11′, 12′, 13′, 14′ are substantially parallel to each other. The wrappers are spaced apart from each other by a predetermined distance. Any distance including a distance of zero magnitude, i.e. where successive wrappers are contiguous with each other, will do. In a preferred application, the wrappers are spaced approximately 2¼ inches apart as measured along the direction of advancement, i.e. points I and J are spaced approximately 2¼ inches apart.

The wrappers are placed on the strip such that their veins are face down. The flag of wrapper 11 is lifted up to expose the veins on the underside of the wrapper which ordinarily would contact the strip 10. The vein side of wrapper 11 also has a paste strip zone 33 at the flag end and a paste circular zone 35 at the tuck end. Paste is applied to these zones as will be described herein.

The spacing between the wrappers of FIG. 3 is selected for optimum compact transport purposes. The closer together the wrappers are spaced, the more compact will be the size of the roll—a feature which is very advantageous to minimize handling, shipment and manufacturing costs.

Returning now to FIGS. 1 and 2, the individual strips 10 on feed reels 22, 24 are successively entrained about a portion of the circumference of transfer rollers 34, 36 which are mounted for rotation in circumferential direction of the arrows K and L, respectively. The transfer rollers 34, 36 each have a foraminous surface with an internal sub-atmospheric pressure so that the wrapper-carrying strips 10 are fixedly held by suction as they each first pass in a continuous and sequential manner along a wrapper transport path in the above-described predetermined arranged relationship as depicted in FIG. 3 underneath the position sensors 37, 38, and thereupon, respectively through the cigar wrapper supply stations 40, 42.

As will be described in greater detail below, the wrappers are picked off their respective strips at the wrapper supply stations 40, 42, thereby leaving the strips without their wrappers to continue towards the rollers 39, 41, and thereupon to the pressure rollers 43, 45 prior to being taken up on right and left hand takeup reels 44, 46, respectively. Takeup reels 44, 46 are journaled for rotation about axis M—M and are driven in circumferential direction of arrows N and O by drive motor 50 via belted drive assembly 49. Guide fenders 51, 52 facilitate the rewinding of the strips, and tension assemblies 53, 54 exert the proper spring tension on the strips as they are being rewound on takeup reels 44, 46.

The delivery of the wrappers to the wrapper supply stations has been described in conjunction with two supply stations, namely stations 40, 42. It will be expressely understood that it is within the scope of the present invention to deliver wrappers to a single supply station, and also to more than two supply stations.

Delivery of Cigar Bunches to Cigar Wrapping Stations

At this point, cigar wrappers, one after another, are being delivered to stations 40, 42. The improved feed arrangement 100, details of which will be described below, is operative for continuously feeding the wrappers to the cigar wrapping station 55 at which the wrappers are spirally applied about cigar bunches to thereby form spirally-wrapped cigars. The cigar bunches are delivered to the wrapping station 55 in the following manner.

The magazine or hopper 56 constitutes a cigar bunch supply station in which a considerable number of cigar bunches are disposed in an orderly array, i.e., each bunch is horizontally oriented and vertically stacked generally one above another. Bunches may come in single or double length sizes. A single bunch has a non-cylindrical, tapering, hemi-ovoidal end region which is adapted to be received in a smoker's mouth, and an opposite cylindrical fire end region which is adapted to be ignited by the smoker. The tuck of the wrapper is first wrapped about the fire end, and the flag end is subsequently wrapped about the mouth end. A double bunch consists of two single bunches coupled at their common fire ends.

In the embodiment of FIGS. 1–15, two wrapper supply stations 40, 42 are provided, and the feed arrangement 100 is operative to deliver two wrappers in chevron configuration to the wrapping station 55. The wrapping means at the station 55 wraps both wrappers simultaneously about the double bunch. Subsequently, the wrapped double bunch is slit to form two wrapped cigars. Of course, it will be understood that the machine may also include a single wrapper supply station and a single wrapping head for single bunches or for double bunches, or successive wrapping heads for single or double bunches, the highest production speeds being achieved when double wrapping heads for double bunches are employed. Such double-headed twinned-bunch wrapping machines may reach speeds on the order of 400 cigars wrapped per minute.

Discharge chute 58 leads the bunches in single file and still in horizontal orientation to the bunch input transport means 60 which constitutes a transfer wheel mounted on shaft 59 for rotation about axis T—T. The wheel 60 has bunch-receiving pockets operative to hold each bunch, in its turn, and transport the same in a continuous and sequential manner from the bunch supply station 56 along a bunch feed path towards the cigar wrapping station 55. Inasmuch as the bunch input transport means forms no essential part of the present invention, a further description of the structural and functional features thereof is not believed to be necessary. Such bunch input transport means are entirely conventional and are well known. For example, reference can be made to U.S. Pat. No. 4,103,692, the entire contents of which are hereby incorporated by reference herein.

Cigar Wrapping

The bunches are delivered by wheel 60 to diagrammatically-illustrated rolling nest chain assembly 62 which is essentially a stretch chain entrained about three rollers. Carrier plates are mounted on the chain and each has a bunch-receiving pocket which is conveyed to, through and past wrapping station 55. Structural and functional details of such rolling nest chain assemblies are likewise conventional and, therefore, a further description thereof is not believed to be necessary. Reference can again be made to the above-identified U.S. patent, wherein means for spirally applying wrappers about bunches to form spirally wrapped-cigars are described.

For purposes of the present application, it is sufficient to note that bunches are delivered to the rolling nest chain at input path portion 64, that wrapping of a bunch with a wrapper essentially begins in the vicinity of path portion 66, that wrapping of a bunch with a wrapper essentially terminates in the vicinity of path portion 68, and that bunches are discharged from the rolling nest chain at output path portion 70. A feed arrangement or wrapper carrier drum 100 is mounted on the machine for rotation about axis P—P. The bunches are conveyed to the wrapping station 55 with their longitudinal axes parallel to the axis of rotation of the drum. The wrappers are conveyed to station 55 at an angle relative to the bunches. After delivery to the wrapping zone, which extends intermediate path portions 66, 68 in circumferential direction about the drum, the bunch is rotated about its longitudinal axis and, at the same time, the bunch and the wrapper experience relative movement in a direction circumferentially with respect to the drum, whereby the wrapper spirals about the rotating bunch. As the wrapper winds about the bunch, it progresses helically from one end to the other with a slight overlap. In the case of double bunches, the wrapper progresses from the center (common fire end region) towards the mouth ends.

Post-Wrapping Cigar Handling

After discharge from the wrapping station 55, the wrapped cigars are transported to the output transport means 72, the structure of which will not be described inasmuch as it is duplicative of the structure of the input transport means 60.

The output transport means 72 conveys the wrapped cigars in succession to the knurler assembly 74, the slitter assembly 76 and the rotary transfer assembly 77, the latter being again identical in structure to the transfer means 60 and 72. Both the knurler and the slitter assemblies are likewise well known in this field and hence, will not be described. Details of such knurler and slitter assemblies can be had by reference to the above-identified U.S. patent.

A discharge conveyer 78 includes a belt 80 having cigar-receiving pockets, e.g., pocket 82, spaced therealong. The belt 80 is entrained about rollers 84, 86 and is operative to convey the cigars to an exit conveyor 90 from which the cigars are transported to the exit of the machine 20.

Delivery of Cigar Wrappers to Cigar Wrapping Station

Turning now in detail to the essential part of the present invention, the novel feed arrangement or wrapper carrier drum 100 is operative to continuously and sequentially move each successively leading wrapper, one after another, relative to its next successively trailing wrapper along a wrapper feed path in circumferential direction of arrow Q to, through and past wrapping station 55. The feed arrangement 100 is operative to respace the wrappers from the spaced-apart relationship of FIG. 3 to a different relationship in which the successive wrappers are spaced apart of each other at greater distances selected for optimum wrapping purposes. We have found that if the wrappers are spaced apart at an original distance of $2\frac{1}{4}$ inches on the carrier tape 10, then it is advantageous to respace the wrappers to distances on the general order of $5\frac{1}{2}$ inches so that each successive wrapper registers with each successive bunch at the wrapping station 55 at substantially the same time. In the embodiment of FIGS. 1–15, this means that the right- and left-hand wrappers, which are oriented in chevron configuration and which are simultaneously conveyed to entry zone 66, are simultaneously wrapped about its respectively associated double bunch to thereby wrap the latter in automatic and non-stop manner.

Figure 4:
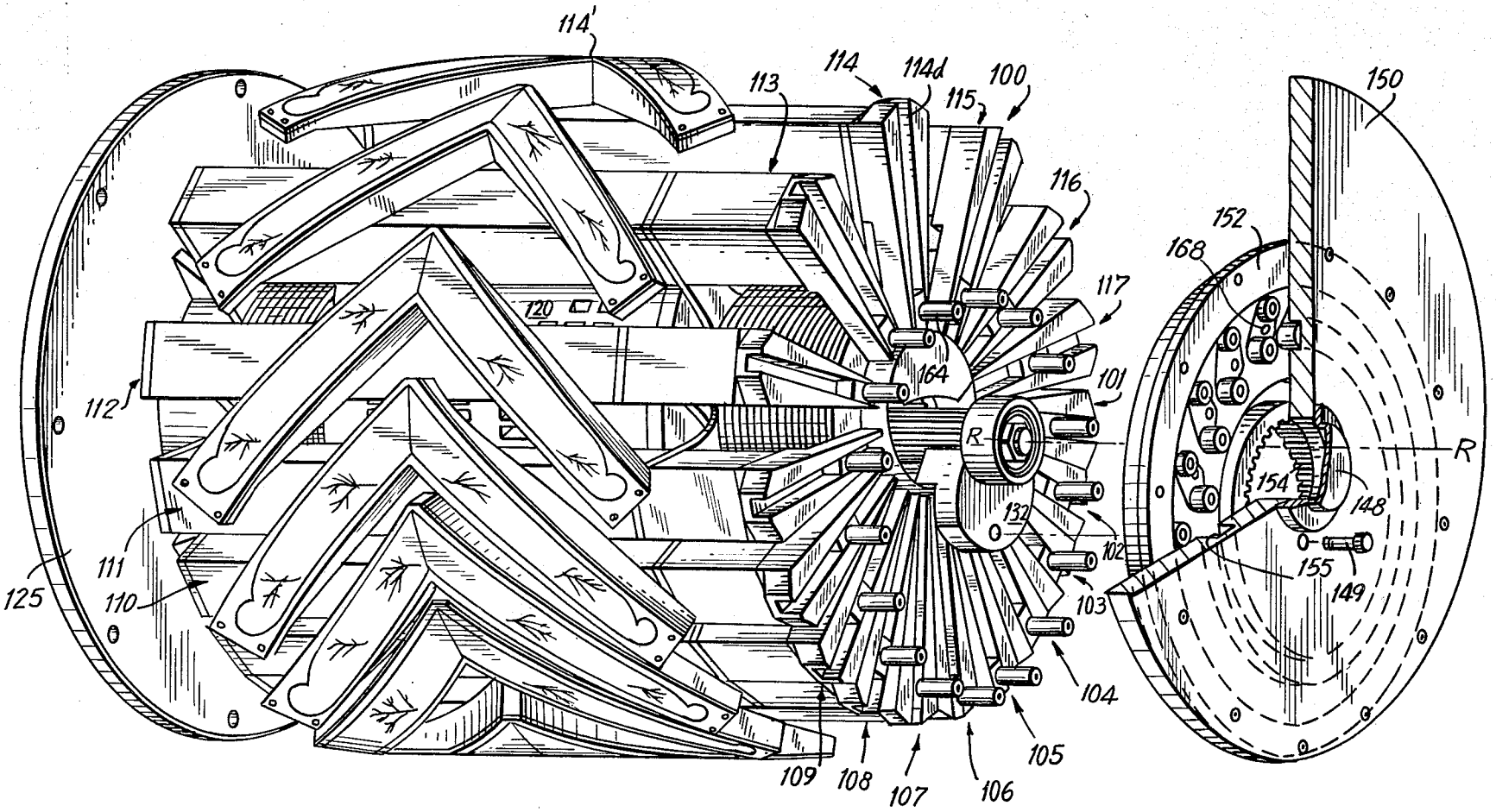
FIG. 4 is an enlarged, partially exploded, partially broken-away, perspective view of the feed arrangement of FIG. 1.
Figure 5:
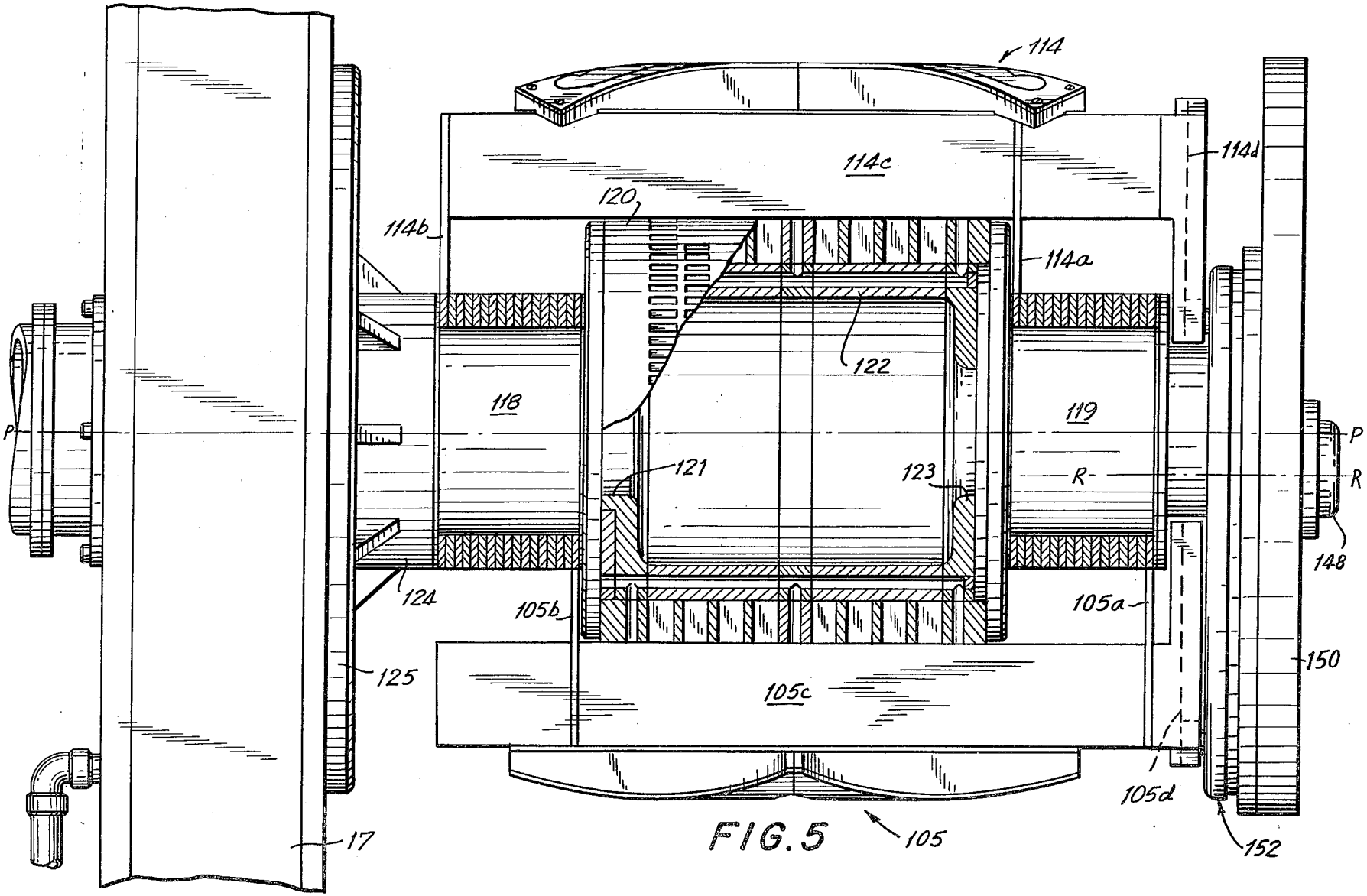
FIG. 5 is an enlarged, partially broken-away, partially vertically sectioned view of the feed arrangement, which has one end region mounted on the mounting frame of the cigar wrapping machine, as taken on line 5—5 of FIG. 1.
Figures 11, 12, 13:
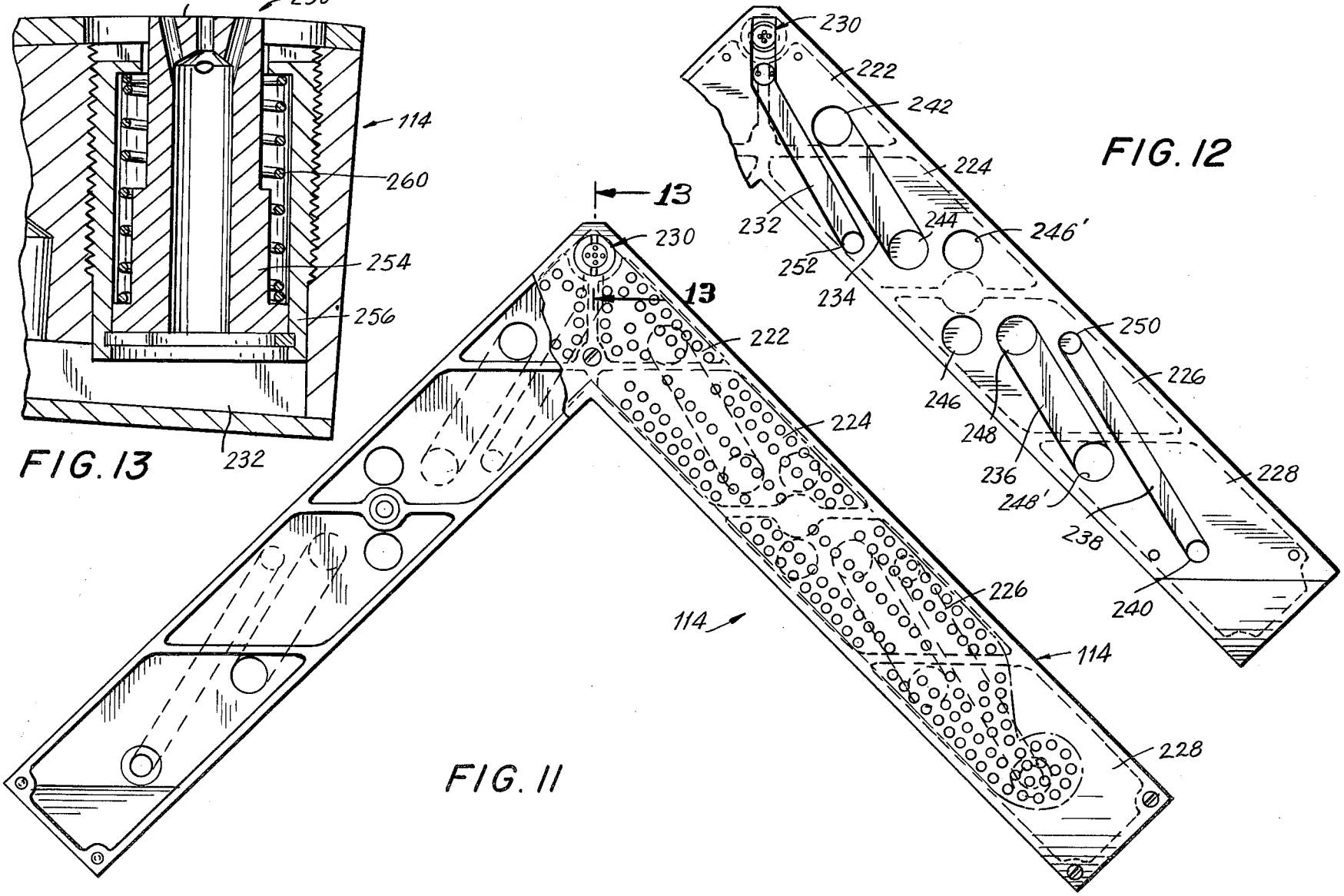
FIG. 11 is a greatly enlarged, partially broken-away, top plan view of one platen of the feed arrangement of FIG. 1.
FIG. 12 is a partially broken-away, bottom view of one leg of the platen of FIG. 11.
FIG. 13 is an enlarged, partially broken-away, vertically sectioned view of the tuck-in pistol as taken on line 13—13 of FIG. 11.

As best shown in FIG. 4, the carrier drum 100 comprises a plurality of platen assemblies 101, 102 . . . 117, all mounted for rotation about axis P—P and on stub shafts 118, 119 which are connected to opposite ends of stator 120. A representative platen assembly, e.g. 114, is shown in detail in FIG. 9. It includes an elongated support 114*c* having an inner curved bottom wall slidable in sealing engagement with a stator 120, a pair of radially extending side walls, and a top wall. The platen assembly 114 also includes a pair of ring carriers 114*a*, 114*b* which are spaced lengthwise of support 114*c* and which are respectively pivotally mounted on stub shafts 119, 118, and a generally V-shaped chevron-type wrapper-carrying platen 114' mounted on the top wall. Platen 114' has two legs each having a slightly circumferentially foraminous wrapper-carrying surface which is perforated in a predetermined pattern which corresponds to the outline of a single wrapper. As best shown in FIG. 11, the perforated outlines of the flag ends of the two wrappers are located at the extreme remote ends of the chevron platen 114', and the perforated outlines of the tuck ends are located at the apex of the platen 114'.

The ring carriers of all of the platen assemblies are spaced in axial direction along shafts 118, 119, and each ring carrier is in sliding sealing contact with its neighboring ring carrier. Each platen assembly has a slide track (see slide track 114*d* in FIG. 9) in which a pusher assembly is received in sliding engagement as will be described below.

A rotor 122 has a cylindrical body portion mounted in sliding sealing engagement with the inner circumferential surface of the cylindrical body portion of stator 120. Shaft extension 121 extends from one end of rotor 122 through the interior of stator shaft 118 which is journaled in cylindrical bushing 124 mounted on mounting plate 125. Mounting plate 125 is mounted on vertical plate 17 of the machine frame such that the drum axis P—P is substantially horizontal to the floor 19.

Shaft extension 123 extends from the other end of rotor 122 through the interior of stator shaft 119, and pinion drive gear 126 is fixedly mounted on extension 123 for rotation with the latter about the drum axis. Sleeve bearings 127, 128 minimize friction losses during rotation of the rotor 122 and drive gear 126, respectively. Drive gear 126 has an inner set 130 of teeth arranged in an annulus about the drum axis P—P. In a preferred application, there are thirty-six teeth in set 130.

A pinion housing 132 has an offset journal portion 134 in which a smooth shaft end portion 136 of pinion 140 is journaled for rotation about pinion axis R—R. The opposite end of pinion 140 has a smooth shaft portion 138 which is journaled for rotation about the pinion axis by ball bearing assembly 142 mounted in housing portion 144, and a threaded shaft portion 146 which cooperates with nut 147 to properly position the bearing 142 intermediate the collar 143 and the nut 147, and also to prevent the bearing 142 from undesirably moving axially along the pinion axis. Pinion 140 typically has about fifteen axially-extending teeth or splines spaced about its exterior. A cap 148 covers the free end of threaded portion 146 and is mounted on stationary cam plate 150. As shown in FIG. 2, cam plate 150 is stationarily and fixedly mounted relative to vertical plate 17 by frame cage 151.

A drive plate 152 includes an internal gear constituted by an inner set 154 of teeth arranged in an annulus about the drive plate axis S—S. Typically, there are fifty-one teeth in set 154. It will be understood that the specified number of teeth on the drive gear 126, the pinion 140 and the drive plate gear 152 can be other than those specifically mentioned above.

The cam plate 150 has a circular cam track 155 in which a cam follower of a pusher assembly is received. A plurality of pusher assemblies, one for each platen assembly, is used. For example, pusher assembly 160 in FIG. 9 cooperates with platen assembly 114 to respace the latter. Pusher assembly 160 comprises a slider bar 162 which is slidably receivable along the length of slide track 114*d*, and a cylindrical post 164 fixedly connected on and extending away from slider bar 162. The pusher assembly also includes a bell crank link 166 having a hole 168 in which a pivot pin mounted on the drive plate 152 is mounted for turning movement with the latter, a cylindrical sleeve 172 at one side of the link 166 operative to pivotally mount the post 164, and a cam follower or roller 174 mounted at the other side of the link 166 and receivable in the cam track 155 in the cam plate.

Figure 10:
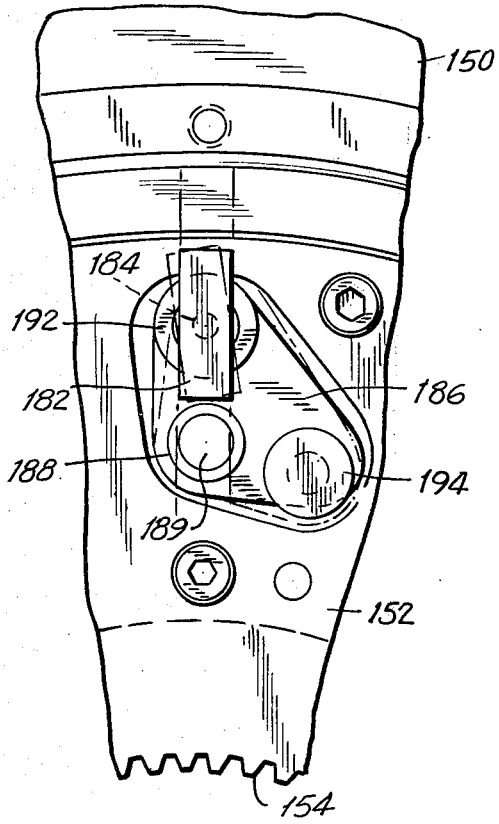
FIG. 10 is an enlarged, partially broken-away, axial end view of the cam roller, bell crank and slider sub-assembly of FIG. 9.

FIG. 10 shows in enlarged view the pusher assembly associated with platen assembly 115 and includes a slider bar 182, a bar post 184, a cylindrical sleeve 192, bell crank link 186, cam follower 194 and pivot pin 189 pivotally mounted in hole 188. The bell crank link performs limited pivoting angular movement about the axis defined by the pivot pin 189, for the purpose explained below.

Feeding Operation

Figure 6:
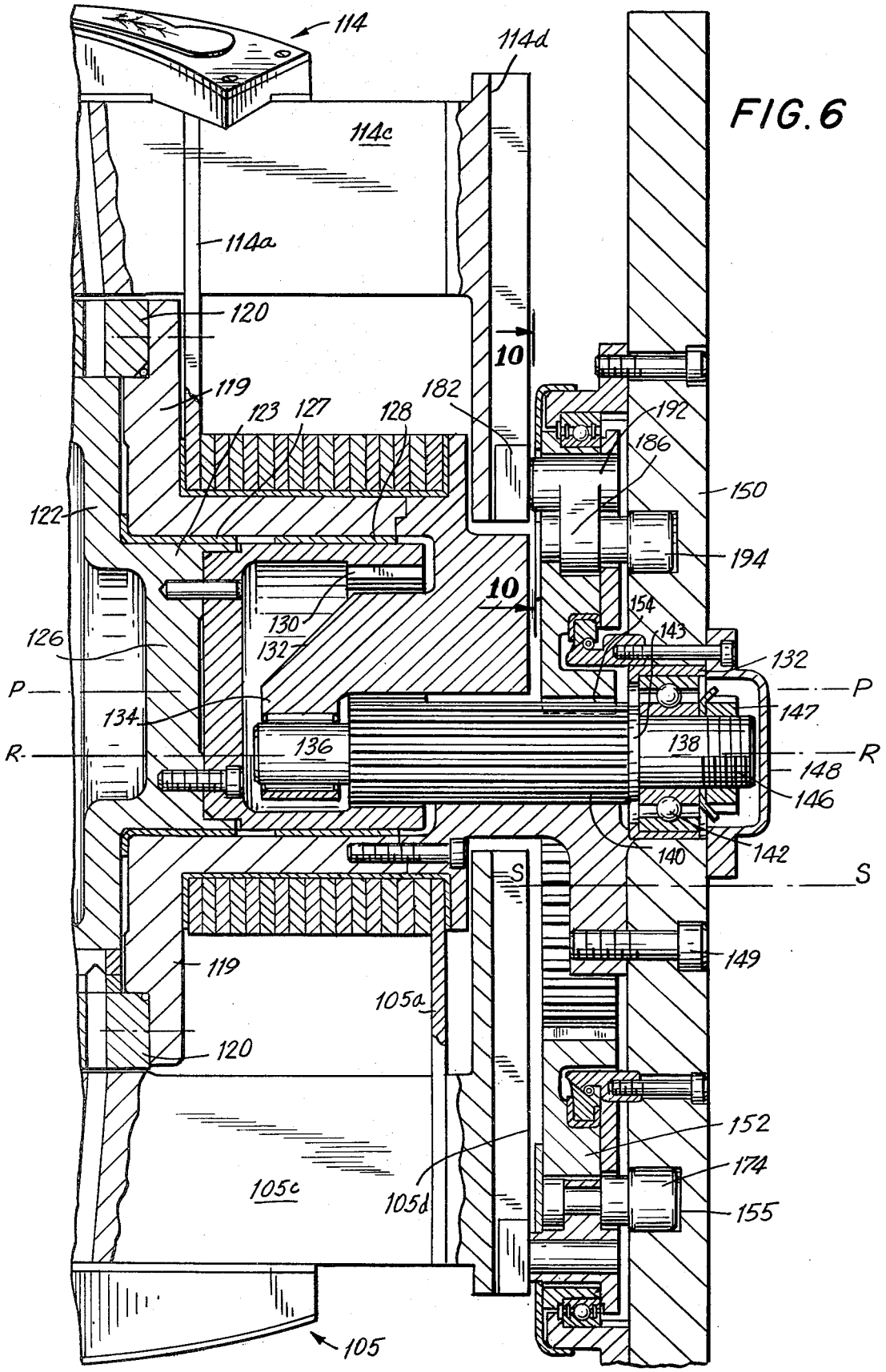
FIG. 6 is an enlarged, partially broken-away, partially vertically sectioned view of the other end region of the feed arrangement of FIG. 1 which is remote from the mounting frame of the cigar wrapping machine.
Figure 7:
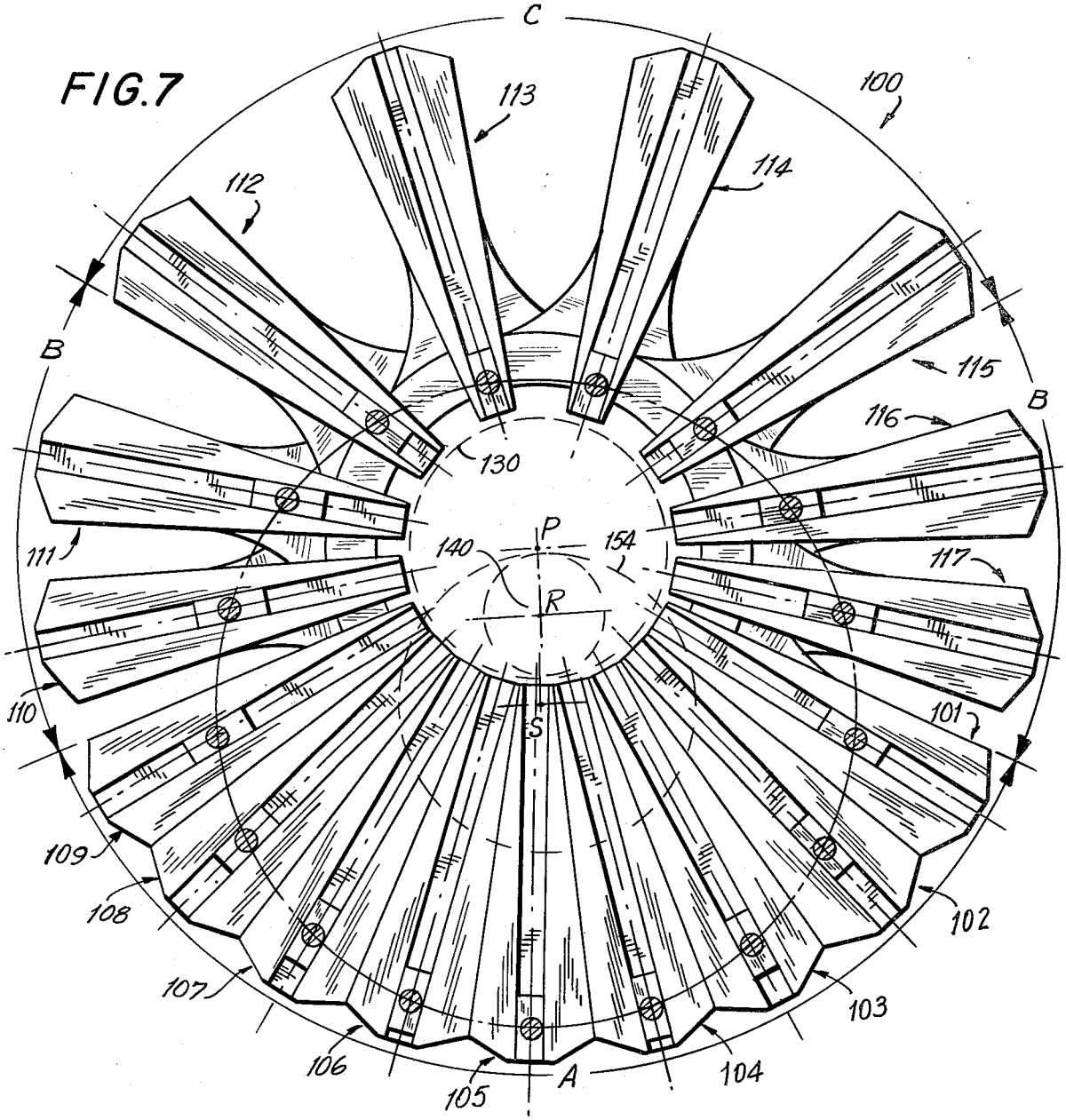
FIG. 7 is an enlarged, diagrammatic, axial end view as taken on line 7—7 of FIG. 4, and shows the relative spacing between the platens and the relative orientation between the sliders of the feed arrangement of FIG. 1.

With respect to FIG. 6, the rotor 122 and the drive gear 126 are turned by the non-illustrated motor and belt drive arrangement about the drum axis P—P. In turn, the pinion 140 is rotated about its longitudinal pinion axis R—R due to the meshing engagement between the teeth of set 130 on the gear 126 and the splined teeth on pinion 140. It will be noted that pinion axis R—R is offset in radial direction from drum axis P—P due to the offset journals 134, 144. In turn, rotating pinion 140 rotates the drive plate 152 about the drive axis S—S which is radially offset from both the drum and pinion axes. The rotary motion of teeth set 130 is converted to the rotary motion of teeth set 154 and, as best shown in FIG. 7, this eccentric motion is responsible for moving the various platen assemblies relative to each other to the relative positions shown in FIG. 7.

As drive plate 152 rotates, the bell crank links mounted thereon rotate with the same and are operative to move their respective platen assemblies. Each cam follower, e.g., roller 194, is forced to travel in circular cam track 155 which is concentric with drive plate axis S—S and, in turn, each slider bar is forced to travel in its associated radially-extending slide track. As the plate 152 rotates, each bar post is compelled to follow the circular path of its associated cam roller and, therefore, each bar post and its associated slider bar are moved through a different distance along their associated slide tracks.

Thus, the torque of the rotor is transmitted via the pusher assemblies to thereby generate a force component which pushes the platen assemblies in circumferential direction. The extent of angular movement through which each platen assembly is moved depends on the location of the respective slider bar in its slide track. As shown in FIG. 7, the slider bar of platen assembly 105 is furthest away in radial direction from the drive axis and assembly 105 and is essentially contiguous with its neighboring platen assemblies 104, 106. By contrast, the slider bars of platen assemblies 113, 114 are closest relative to the drive axis and these are spaced at the greatest angular distance relative to their neighboring platen assemblies 112, 115.

The respacer mechanism would normally generate a sinusoidal-type variation in the angular distance between the platen assemblies, i.e. the angular distance between platen assemblies 105 and 106 would be a minimum value, the angular distance between assemblies 106 and 107 would be slightly greater than the minimum value, and so on, until the maximum angular distance would be obtained between platen assemblies 113 and 114. The angular distance would progressively decrease in value from the aforementioned maximum value to smaller values as one measures the distance between assemblies 114 . . . 117 and 101 . . . 105.

The present invention proposes to modify this sinusoidal characteristic inasmuch as it is advantageous to maintain the relative spacing between platens relatively constant, particularly in the wrapper pickup zone A and the wrapping zone C (see FIG. 7). As noted above, the V-shaped platen is supplied with two wrappers, one from supply station 40, and the other from supply station 42. These supply stations are spaced laterally and longitudinally apart from each other and, therefore, it is very desirable not to change the spacing between platens in pickup zone A in order to reliably position the wrappers on the platens. Moreover, the paste station 95 which is operative for applying glue on zones 33, 35 (see FIG. 3) of the wrappers is located adjacent the pickup zone in order to uniformly apply the paste on the wrappers in a controlled, uniform manner. As for the wrapping zone C, maintaining the relative angular spacing between successive platens insures uniform and proper wrapping of the wrappers.

Figure 8:
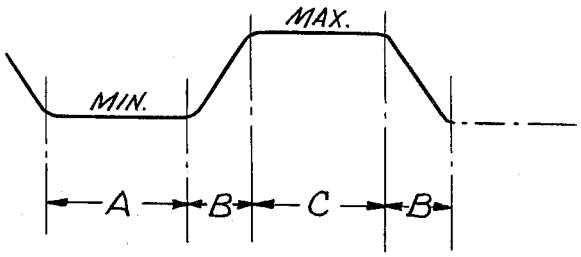
FIG. 8 is a schematic representation of the change in the circumferential spacing between the platens in the areas designated in FIG. 7 as A, B and C.
Figure 9:
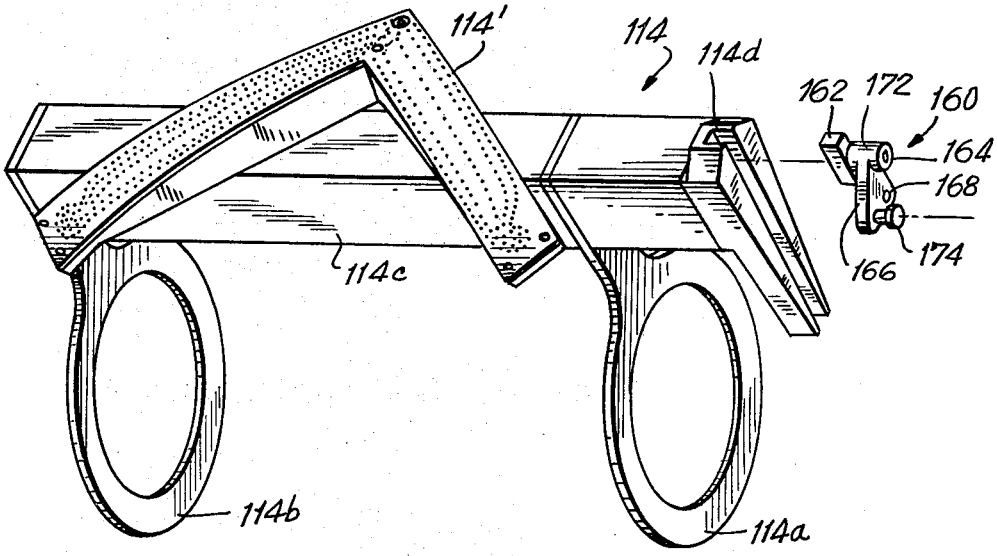
FIG. 9 is a greatly enlarged, partially exploded, perspective view of one platen carrier of the feed arrangement of FIG. 1 and its associated cam roller, bell crank and slider sub-assembly.

The limited pivoting action of the bell crank links, as shown in dashed lines in FIG. 10, modifies the aforementioned sinusoidal characteristic to the flattened characteristic shown graphically in FIG. 8. The limited angular pivotal movement of each link about its pivot pin permits the angular spacing to reach its maximum and minimum values at a constant level for a longer time period as compared to the sinusoidal characteristic.

Thus, in the pickup zone A, the platen assemblies are maintained substantially constant at a minimum value, i.e. zero angular spacing in which the platen assemblies are contiguous with each other in the so-called "closed" position. In the wrapping zone C, the platens are maintained substantially constant at a maximum value, i.e. a value selected for optimum wrapping purposes, the platens being spaced apart in the so-called "open" position. In the two transition zones B, the angular spacing between platen assemblies increases gradually as one moves from platen assembly 109 to assembly 112, and thereupon decreases gradually as one moves from platen assembly 115 to assembly 101.

Wrapper Transfer

At supply stations 40 and 42, wrappers from transfer rollers 34, 36 are transferred to the right- and left-hand legs of each successively leading V-shaped platen. This transfer is accomplished by generating a sub-atmospheric pressure at the wrapper-carrying surfaces of each platen at the pickup zone to thereby retain the wrappers on the associated platen by suction. En route to the wrapping station 55, the suction is maintained even though the platen assemblies are moved apart of each other. At the wrapping station, the suction must be gradually terminated in order to progressively release the wrapper along its length to permit the wrapping operation to be performed. The suction is not regenerated until the platen assembly reaches the first wrapper supply station 40 and, in fact, an above-atmospheric pressure is generated not only to affirmatively push the wrapper off its platen, but also to clean the vacuum ports of any particulate debris. A preferred arrangement for implementing these functions is illustrated in FIGS. 11–15.

Figure 14:
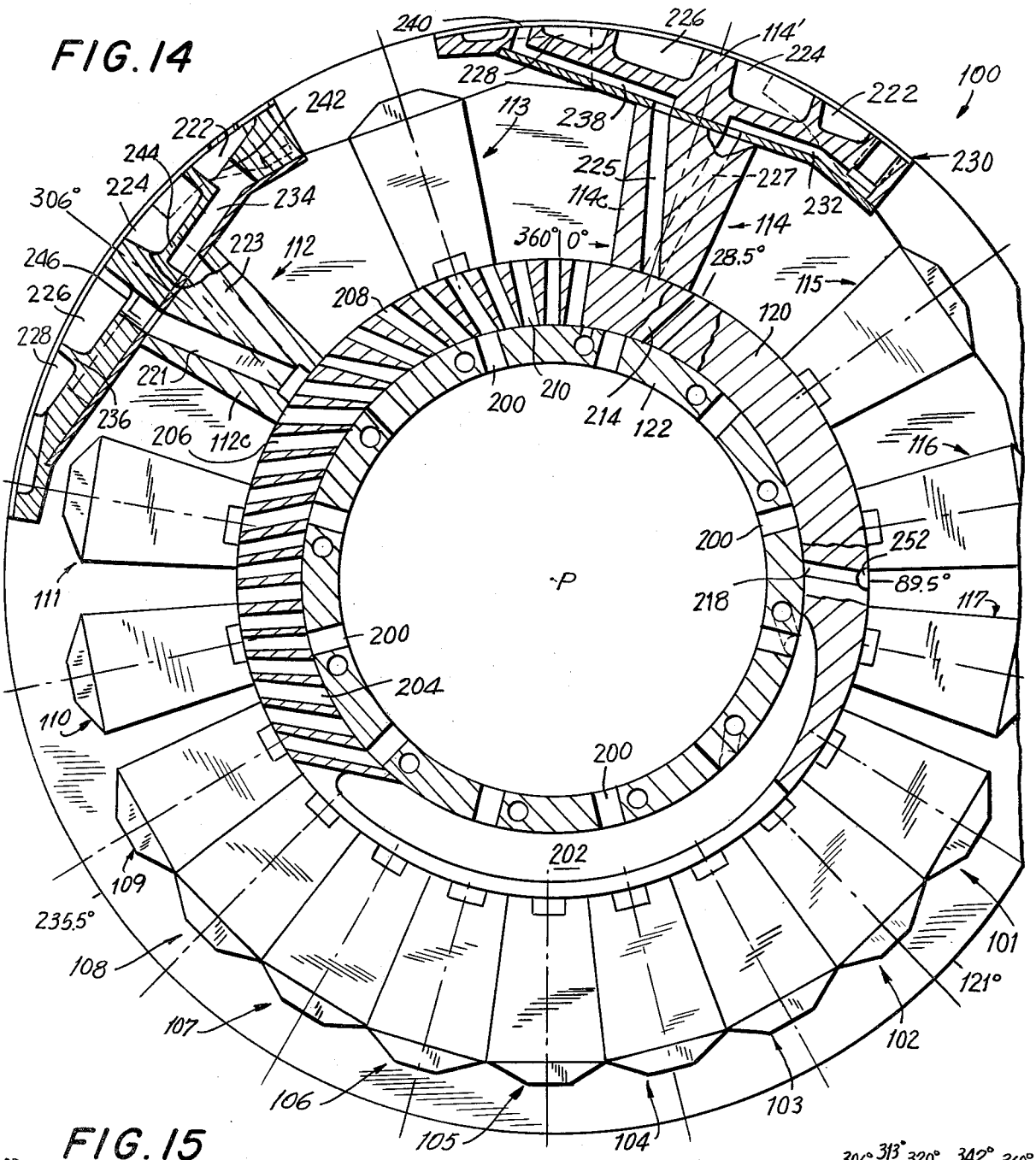
FIG. 14 is an enlarged, partially broken-away, partially diagrammatic, partially sectioned view of the feed arrangement of FIG. 1 as seen in cross-section.

Referring in detail to FIG. 14, the cylindrical body portion of rotor 122 has a plurality of radially-extending vacuum ports 200, each port having one end in communication with the hollow rotor interior in which a sub-atmospheric vacuum condition is maintained, and an opposite end located at the outer circumferential surface of the rotor and operative for communicating the vacuum to the exterior of the rotor. The vacuum ports, preferably twelve in number, are equi-angularly and equi-distantly spaced about the drum axis P—P.

The stator 120 surrounds the rotor and has an inner circumferential surface in sliding sealing engagement with the outer surface of the rotor 122. The cylindrical body portion of stator 120 has a pair of vacuum chambers 202, 202', and a plurality of vacuum channel groups, four of which are identified by reference numerals 204, 206, 208, 210, formed therein. Each chamber 202, 202' extends over a part of the circumference of the stator and has one open side in communication with at least one of the vacuum ports 200, and another open side for communicating the vacuum to the exterior surface of the stator. Each channel group extends transversely through the stator and has open ends at both the inner and the outer circumferential stator surfaces. The channel groups are each inclined at different angles relative to each other. Each channel group consists of a predetermined number of channels spaced apart of each other in axial direction. Each channel has a generally rectangularly-shaped open end at the stator surface.

Figure 15:
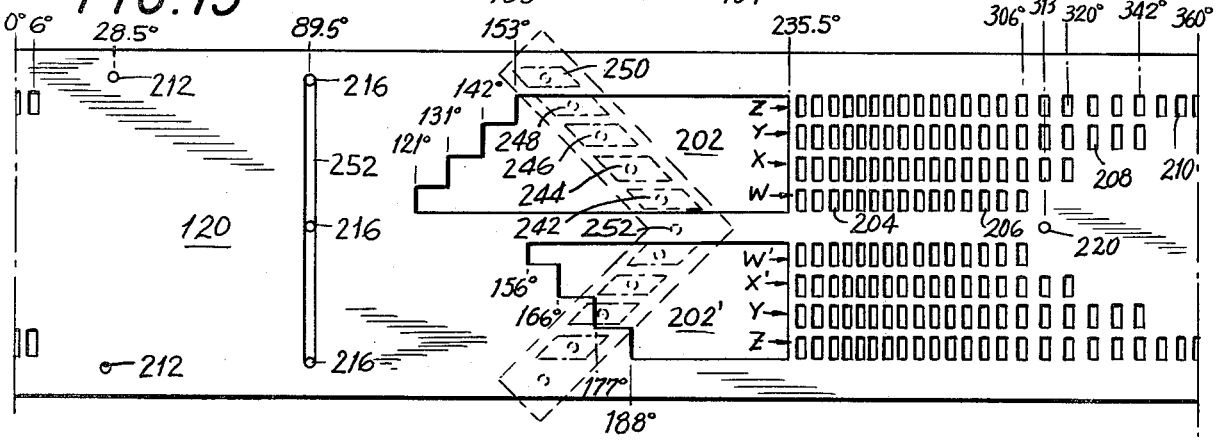
FIG. 15 is a developed view of the outer circumferential surface of the stator of the feed arrangement of FIG. 1.

The development of the outer surface of the stator is shown in FIG. 15, wherein the layout of the open sides of chambers 202, 202' and of the open ends of the channel groups 204 . . . 210, is shown. The angular positions of these openings are given in degrees and can be compared to the angular reference degree markings specified in FIG. 14. For example, the open ends 212 of flag pop-off channels 214 are approximately located at the 28.5° mark; the open ends 216 of the purge channel 218 are approximately located at the 89.5° mark; the chamber 202 has four sections, each respectively beginning at the 121°, 131°, 142° and 150° marks; the chamber 202' has four sections, each respectively beginning at the 156°, 166°, 177° and 188° marks; both chambers terminate at the 235.5° mark; and the open end 220 of the tuck pop-off channel is located approximately at the 313° mark. The channel groups form circumferentially-extending rows W, X, Y, Z and W', X', Y', Z', and it will be noted that each row W, W' comprises fifteen channel openings, each row X, X' comprises seventeen channel openings, each row Y, Y' comprises twenty channel openings, and each row Z, Z' comprises twenty-four channel openings. The channel groups comprise eight, six, four and two channels at the 306°, 320°, 342° and 6° marks, respectively.

As noted above, the bottom walls of the platen assemblies slide in sealing engagement with the outer stator surface. Each assembly includes a support in which a pair of vacuum passages and a pair of high positive pressure passages are formed. To simplify the drawings and the description, representative platen assembly 112 in FIG. 14 has been sectioned to show the vacuum passages 221, 223, and representative platen assembly 114 in FIG. 14 has been sectioned to show the high pressure passages 225, 227.

As best shown in FIGS. 11 and 12, each leg of each platen has a first leading compartment 222, a second compartment 224, a third compartment 226, and a fourth trailing compartment 228. A tuck pop-off piston sub-assembly 230 is located at the apex of each V-shaped platen. One end of passage 232 communicates with the pop-off assembly 230 as will be explained below, and the opposite end 252 of passage 232 communicates with pressure passage 227. One end 242 of passage 234 communicates with first compartment 222 and the opposite end 244 of passage 234 communicates with vacuum passage 223. Passage 246 communicates with third compartment 226 and with vacuum passage 221. One end 248 of passage 236 communicates with both the third and the fourth compartments 226, 228. One end 250 of passage 238 communicates with pressure passage 225, an the opposite end 240 of passage 238 underlies the flag end of a wrapper carried on the platen. The left- and right-hand legs of each platen are provided with a separate porting and only the porting for one leg will be described for the sake of brevity.

In operation, as each platen assembly is moved over the outer stator surface in accordance with the respacer arrangement described above, the passages 221, 223, 225, 227 successively register with the various components in the stator outer surface in the following manner. In the position shown in FIG. 14, platen assembly 101 is next in line to communicate its internal porting with the vacuum chamber 202. The vacuum within rotor 122 is conveyed through the vacuum ports 200 and vacuum chamber 202 to the internal porting of platen assemblies 102–108. Each compartment of the assemblies 102–108, in its turn, receives a sub-atmospheric pressure therein. Thus, open end 242 transmits the vacuum to first compartment 222 only after the open end 242 passes the 121° mark (see FIG. 15). In turn, open ends 244, 246, 248, respectively transmit the vacuum to the second, third and fourth compartments only after the open ends 244, 246, 248 respectively pass the 131°, 142° and 153° marks. This progressively-applied suction force is operative to secure a wrapper in fixed position and in successive lengthwise manner on the platen.

Platen assemblies 101–109 are pressed tightly and sealingly against each other in the wrapper pickup zone A, and this contiguous sealing contact prevents excessive vacuum loss between the assemblies. It is in this "closed" platen spacing that the wrappers are transferred in veins-up condition from the transfer rollers 34, 36 at the common points of tangency (i.e., at the wrapper supply stations 40, 42) to the platens. The left-hand wrappers need not be applied at the different downstream location as compared to the transfer point of the right-hand wrappers.

At the downstream side of the wrapper pickup zone, the paste station 95 is operative to apply a drop of paste at circular zone 35 and a strip of paste at strip zone 33 by use of a patterned roller. The paste may be a mild, water-based glue, as a tragacanth-based gum, or a CMC glue. Of course, other glue types at other sites of application for the glue are likewise possible and varies according to design considerations.

Platen assemblies 110, 111 are angularly spaced relative to each other, and therefore the vacuum can no longer be supplied by a single vacuum chamber without vacuum loss through the area of separation between the assemblies. Therefore, the vacuum channels 204, 206, 208, 210 in the stator are narrower, and these individual channels are appropriately angled to connect the openings in the base wall of the support with the proper opening in the rotor. As the assemblies 109–111 advance and increase in relative spacing, the angle of inclination of the narrow channels are changed to fit the advanced position The channel spacing has been designed so that the bottom wall of each support always communicates with at least one of the channels in the stator and with one vacuum port 200 in the rotor. Also, the vacuum channels which communicate with the space between the separated platen assemblies are prevented from communicating with the rotor interior due to the non-aligned position of the vacuum ports 200. Thus, platen assemblies 109–111 maintain a vacuum condition at their respective wrapper carrying surfaces no matter where they are located along the transition region B. The wrappers do not fall off the platens, because the suction force is always present, and because there is no appreciable vacuum loss to the space between the assemblies even though the latter separate.

Platen assemblies 112, 113, 114 are respectively located substantially at the beginning, the middle and the end of the wrapping station 55. After open end 242 passes the 306° mark, the first compartment is no longer in communication with the vacuum source, and therefore, the tuck end of the wrapper is released for the onset of the wrapping operation. In turn, after open ends 244, 246, 248 respectively pass the 320°, 342° and 6° marks, the second, third and fourth compartments no longer communicate with the vacuum source, and therefore, the respective trailing portions of the wrapper are sequentially released to thereby permit the wrapping operation to be completed in sequential manner.

The internal porting of platen assemblies 115, 116, 117 is not connected to the vacuum source until the next cycle. During the rotation of the assemblies, a high positive pressure source is connected to flag pop-off port 214. At the 28.5° mark, the open end 212 communicates with open end 250 of passage 238. The positive pressure at open end 240 is operative to affirmatively pop or blow the flag end off the platen.

The positive pressure source is also connected to purge line 218. At the 89.5° mark, the open end 216 and groove 252 simultaneously communicate with all of the open ends 242, 244, 246, 248, 250. The positive pressure in all of the internal ports is operative to affirmatively blow out any particle debris blocking the apertures in the wrapper-carrying surfaces of the platen. It will be appreciated that the wrapping machine does not operate in a "clean" room free of airborne particulate matter and, indeed, since the machine is handling a natural product, i.e. tobacco which sheds particles and, furthermore, since the suction ports are, at various parts of their travel, exposed to a particle-laden atmosphere while suction is present thereat, the passages associated with these ports cannot be prevented from inspirating foreign material. It, therefore, is desirable to periodically clean these ports. This purge operation may be set up on a time basis in order to minimize the use of the air pressure source.

The positive pressure source is also connected to a non-illustrated tuck pop-off port. At the 313° mark, the open end 220 of the tuck pop-off port communicates with the open end 252 of passage 232. The positive pressure in the passage 232 is operative to affirmatively pop or blow off the tuck ends of both wrappers off their common platen.

As best shown in FIG. 13, a tuck pop-off assembly 230 is located at the apex of the platen. Piston 254 is mounted for sliding movement in sleeve 256 which is threadedly mounted on the platen. Piston 254 has an upper circular wall 258 which underlies a portion of both tuck ends of the wrappers. In operation, the positive pressure in passage 232 is operative to push the piston 254 such that its upper wall 258 is raised above the wrapper-carrying surface, thereby lifting the leading ends of the wrappers. This action permits the wrapping operation to begin in a reliable, controlled manner. The tension spring 260 returns the piston back to its original position when the positive pressure source is removed.

To briefly recapitulate the entire operation of the wrapping machine described above, the wrappers and their carrier tapes are transferred by suction to the transfer rollers 34, 36, and thereupon the wrappers are continuously and sequentially conveyed to the wrapper supply stations 40, 42, at which the individual wrappers are transferred by suction to the carrier drum 100 at their common points of tangency with the platens in the wrapper pickup zone. The suction means associated with the drum maintains positional control of the wrappers to, through and past the paste station 95, and thereupon far enough into the wrapping station 55 to prevent any part of a wrapper from being free to change its position except for the wrapping operation. At the wrapping station, the suction maintains positional control of the wrappers by progressively releasing successive portions of the wrappers as they are wrapped due to the timing between the rotor and the stator described above.

Similarly, positional control is maintained over the bunches. The bunches at bunch supply station 56 continuously nudge the leading bunch through chute 58 towards the input transfer wheel 60 which picks up each leading bunch in its turn and conveys it to the wrapping station where synchronization is made with each leading pair of wrappers even though the platens rotate about the drum axis at a changing rate of speed.

The continuous movement of the bunches and the wrappers through the machine overcomes the semi-automatic prior art machines; that is to say, the wrappers move continuously from the time they first are loaded on the machine until the time they are wrapped about the cigars and, similarly, the bunches move continuously from the bunch supply station 56 through the machine. All operations of the present invention are performed upon and by moving wrappers and bunches, and the moving parts are not actuated intermittently nor moved by hand with a concomitant slowdown in operations.

The spiral application of the wrappers about the bunches is performed continuously on any given bunch and its associated wrapper. To maximize output of the machine, such wrapping action is practiced upon successive bunches and wrappers in an overlapping manner. Put another way, after one bunch has been partially wrapped, the wrapping of a succeeding bunch is started and if desired, while the first two bunches are being wrapped but are at progressively different stages of the wrapping operation, another bunch or other bunches may have progressed part-way through their wrapping operations, so that at any given time, more than one bunch is being wrapped and having wrappers spirally applied thereto. The overlapping in wrapping operation is very desirable in mass production.

Delivery of Wrappers (Embodiment of FIGS. 16–22)

Figure 16:
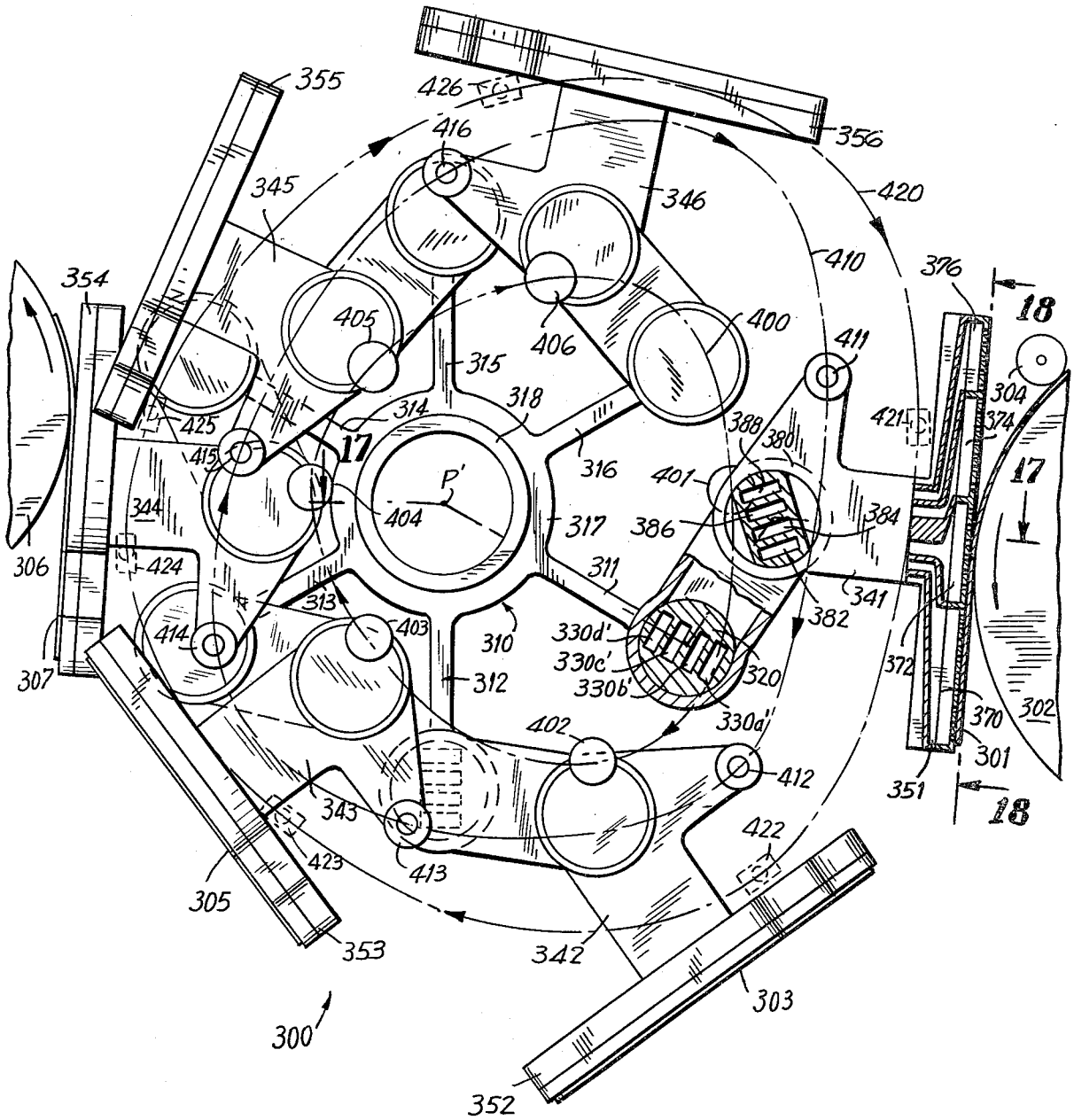
FIG. 16 is a partially broken-away, partially diagrammatic, partially vertically sectioned axial end view of a second embodiment of a feed arrangement in accordance with the present invention.

Turning now to the second embodiment of the feed arrangement 300 for feeding cigar wrappers to a wrapping station of a wrapping machine, reference numeral 302 in FIG. 16 generally identifies a rotary transfer drum on which wrappers are carried after being cut into the appropriate shape by the rotary cutter 304. As noted above, the narrow sheet of natural or reconstituted tobacco material may be transferred to the drum 302, and the rotary cutter 304 has a patterned cutting surface which, upon engagement with the tobacco sheet, cuts the sheet into a series of wrappers each having a leading tuck end region and a trailing flag end region, as described above in detail in connection with FIG. 3.

The feed arrangement 300 is operative to convey these cut wrappers 301, 303, 305, 307 to a conventional rotary wrapping drum 306. Once the wrappers have been transferred by suction to the wrapper-carrying surface of the wrapping drum 306, the drum will convey the wrappers first to a paste station, such as paste station 95 in FIG. 1, and thereupon to a wrapping station, such as wrapping station 55 in FIG. 1. Further details of such stations have been eliminated from FIG. 16 in order to more clearly emphasize the structure and function of the elements of the feed arrangement 300.

Before describing the operation of the feed arrangement 300 in detail, it is important to note several differences between this second embodiment and the first embodiment of FIGS. 1–15. The wrapper stock in the first embodiment is fed in the side-by-side configuration shown in FIG. 3, and the feed arrangement 100 is operative to respace the wrappers from the closed position to the open position in which the respective distances between the successive platen assemblies (i.e. between the wrappers) is increased.

By contrast, in the second embodiment, the wrapper stock is fed from narrow strip stock in end-to-end alignment, that is, the wrappers are all colinear, and the flag end of any leading wrapper is arranged in a row linearly ahead of the tuck end of the next trailing wrapper. Moreover, the feed arrangement 300 is operative to respace the wrapper stock from first positions in which the wrappers are spaced on the cutting drum 302 at a relative spacing selected for optimum compact transport purposes, to second positions in which the wrappers are delivered to the wrapping drum 306 at a relative spacing selected for optimum wrapping purposes. The spacing between the wrappers in the second positions is smaller than the spacing between the wrappers in the first position—in direct contrast to the first embodiment, wherein the reverse is true.

Furthermore, the wrappers which are initially in end-to-end alignment on the drum 302 are reoriented to the "side-by-side and inclined" alignment of FIG. 3 by the feed arrangement 300, when the wrappers are ultimately delivered to the wrapping drum 306. Although any number of rows of wrappers could be selected, the feed arrangement 300 will be discussed in connection with a pair of rows of wrappers, one being termed the right-hand row, and the other being termed the left-hand row. The feed arrangement 300 is operative for picking up a wrapper from each row, the wrappers being parallel to each other, and also being operative for reorienting these parallel wrappers into a V-shaped, chevron-type orientation. As will be shown herein, the feed arrangement 300 not only respaces, but also simultaneously reorients the wrappers during their travel to the wrapping drum.

Still furthermore, in order to facilitate the transfer of wrappers from a circumferential surface of a drum to a generally flattened surface of a wrapper-carrying platen, the feed arrangement 300 is also operative for simultaneously tilting each platen as it approaches the respective drum.

Figures 17, 19, 20:
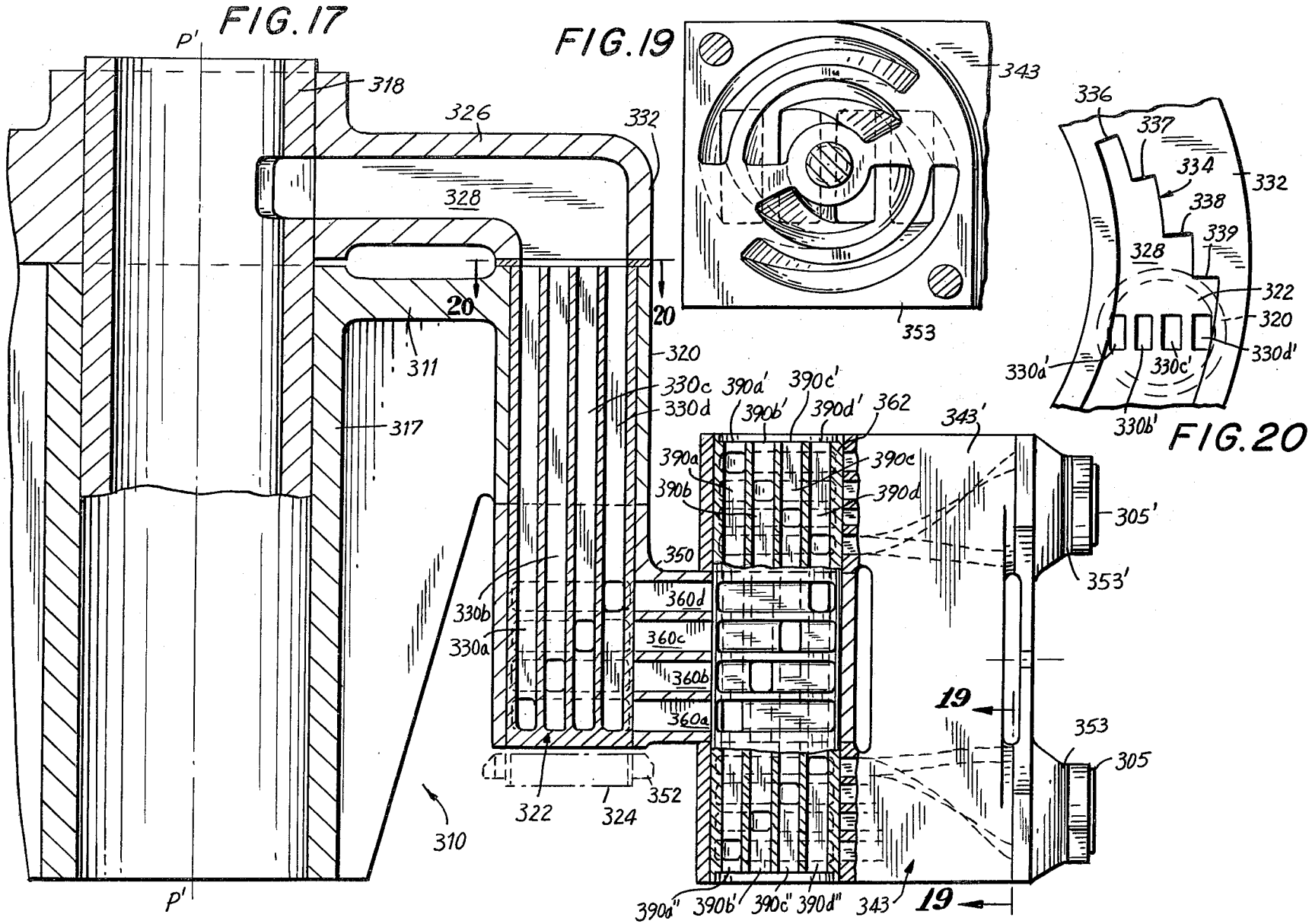
FIG. 17 is an enlarged sectional view as taken on line 17—17 of FIG. 16.
FIG. 19 is an enlarged, sectional view as taken on line 19—19 of FIG. 17.
FIG. 20 is an enlarged sectional view as taken on line 20—20 of FIG. 17.

Turning now specifically to FIGS. 16 and 17, the feed arrangement 300 includes a star wheel 310 having a driven tubular hub portion 317 which is mounted about a hollow shaft 318 for rotation relative to the latter about drive axis P'—P'. A plurality of radially-extending arms or spokes 311–316 extend from the hub 317 in equi-angular relationship relative to each other. A plurality of axially-extending cylindrical sleeves such as 320 is carried at the remote outer ends of each spoke for rotation with the latter about the drive axis.

A cylindrical insert 322 (see FIG. 21) has one end mounted in each cylindrical sleeve 320, and an opposite threaded end 324. Four vacuum passages 330*a, b, c, d* extend lengthwise through the insert 322. Upper open ends 330*a', b', c', d'* are located at an end wall of the insert and face the valving member 326, and lower open ends 330*a'', b'', c'', d''* are located on the cylindrical side wall of the insert.

The valving member 326 is mounted on shaft 318 above the star wheel. Valving member 326 has an internal vacuum chamber 328 which communicates with the interior of shaft 318. As best shown in FIG. 20, the valving member 326 has a circular flange 332 concentric with the drive axis. A vacuum-timing cutout 334 having wall edges 336, 337, 338, 339 is operative to sequentially open or shut off communication between the vacuum chamber 328 and the vacuum passages 330*a, b, c, d* as the insert 322 and its associated sleeve 320 pass underneath and in sealing engagement with the flange 332, as will be described in greater detail below.

A plurality of elbows such as 350 are associated with each insert 322. Elbow 350 has one axially-extending cylindrical portion which receives the remaining portion of the insert 322 which is not located within sleeve 320. Threaded portion 324 extends through said one cylindrical elbow portion, and the elbow is mounted for rotation with the star wheel by threading threaded nut 352 on threaded portion 324. Elbow 350 has another radially-extending cylindrical portion through which a plurality of vacuum passages 360*a, b, c, d* extend. Passages 360*a, b, c, d* communicate respectively with passages 330*a, b, c, d*.

A plurality of cylindrical distributing elements (see FIG. 22) are associated with each elbow. Distributing element 362 has a plurality of vacuum passages 390*a, b, c, d* which extend lengthwise of element 362 and which have open ends 390*a', b', c', d'* at one end region thereof, and open ends 390*a'', b'', c'', d''* at the opposite end thereof. Distributing element 362 is mounted on elbow 350 such that passages 390*a, b, c, d,* respectively communicate with passages 360*a, b, c, d.* One end of distributing element 362 serves to supply the vacuum to the left platen assembly and the other end of the distributing element 362 serves to simultaneously supply the vacuum to the right platen assembly.

A plurality of right-hand platen carriers or links 341–346 are each respectively pivotally mounted on one end region of distributing element 362. An identical set of left-hand platen carriers are mounted at the other end region of the distributing element 362. A plurality of wrapper-carrying platens 351–356 are each mounted on the right-hand links 341–346. An identical set of left-hand platens is mounted on the left-hand links. Each platen has four separate vacuum compartments such as compartments 370, 372, 374, 376 in platen 351. Each compartment in platen 351 is connected by internal porting to a cylindrical suction inlet member 380 having suction inlet ports 382, 384, 386, 388.

The respacing, reorienting and tilting movements mentioned above are each obtained by mounting cam followers or rollers on each link, and by moving such rollers along specially designed cam tracks. FIG. 16 diagrammatically shows the respace cam track path 400, the tilt cam path 410, and the reorient cam path 420. Each of these paths is circumferentially complete and is roughly, but of course not truly, elliptical in shape in the sense that the radial distance between the drive axis P' and any point on these paths changes as a function of the position along the respective path. Respace cams 401–406 are respectively mounted on links 341–346; tilt cams 411–416 are respectively mounted on links 341–346; and reorient cams 421–426 are respectively associated with links 341–346.

As best seen in FIG. 18, right-hand platen 351 and left-hand platen 351' are spaced in mutually parallel orientation (solid lines) at the wrapper pickup station, i.e. at drum 302. The reorient cam follower or roller 421 is operative to reorient the platens into the chevron-type configuration (phantom lines) when the platens arrive at the wrapping drum 306. Each platen 351, 351' is mounted on a gear sector 432, 432' for limited turning movement with the latter. Gear sectors 432, 432' intermesh and move relative to each other when a cam surface on gear sector 432 engages the reorient cam 421 during its travel along track 420.

As respace cam follower or roller 401 travels along its track 400, the roller 401 is operative to change the radial distance between each link and the drive axis. The angular rotation of each link is constant, but the spacing between adjacent platens increases as the radial distance increases. Thus, the distance between platens is decreased at the drum 306, as compared to the distance between the platens at the drum 302.

As tilt cam follower or roller 411 travels along its track 410, the radial distance of each link relative to the drive axis changes as a function of the position of the link on the track. The tilt cam roller 411 establishes the tilting of the platens and aids in moving the flattened platen surface across a rotating cylindrical drum, i.e. the position of a platen relative to the drum is controlled so that the platen will touch the circumferential surface of the drum only at the point of tangency.

The pickup and release of the wrappers to and from the platens is achieved by sequentially establishing and disestablishing a vacuum in a compartment-by-compartment manner. For the pickup operation at the drum 302, a sub-atmospheric pressure condition is generated within the interior of shaft 318, and this vacuum is propagated to the vacuum chamber 328. The sliding valve member 326 is operative to selectively cause a vacuum to be propagated first in passage 330*a* and then, after a time interval, in both passages 330*a* and 330*b* and then, after another time interval, in passages 330*a*, 330*b* and 330*c* and then, after still another time interval, in passages 330*a* and 330*b* and 330*c* and 330*d*. This can be seen and understood from FIG. 20, wherein open end 330*a'* communicates with chamber 328 only after open end 330*a'* has passed edge 336, and wherein open ends 330*a', b', c', d'* begin to communicate with chamber 328 only after open ends 330*b', c', d'* have passed wall edges 337, 338, 339, respectively.

Once the vacuum is introduced to passages 330*a, b, c, d*, it is respectively propagated through passages 360*a, b, c, d*, and in turn, to passages 390*a, b, c, d*, wherein the openings of these latter passages at the opposite ends of the distributing element 362 simultaneously present the vacuum for both the right and the left hand links through internal porting in the latter.

The interface between link 343 and its platen 353 is shown in FIG. 19, wherein the platen has four curved slots, extending in circumferential direction for an arc length less than 360°. Each curved slot is located so that communication with the respective rectangularly-shaped passage in the link will be continued even though the pivoting platen is reoriented in circumferential direction relative to the link.

In analogous manner to that described in FIG. 20, the wrapper carried by platen 354 is gradually released in lengthwise area steps at the wrapping drum 306. During this time, the vacuum in chamber 328 is prevented from passing into passages 330*a, b, c, d* by placing the flange wall intermediate the chamber 328 and the passages 330*a, b, c, d*.

If desired, a high positive pressure source can be generated within the shaft 318 on a time-sharing basis. This above-atmospheric pressure can be propagated through all of the vacuum passages during the time period in which the platens are returning to the drum 302. This high pressure can be used to blow out any particulate debris from the vacuum passages to insure clean, reliable operation for the next cycle.

Delivery of Cigar Wrappers (Embodiment of FIGS. 23–25)

Turning now to FIG. 23, reference numeral 500 generally identifies another feed arrangement operative for continuously feeding, in sequential manner, cigar wrappers to a wrapping station. A row of wrappers in end-to-end alignment is carried by rotary transfer drum 502, and is delivered by the feed arrangement 500 to the wrapping drum 504. As in the case of the FIG. 2 embodiment, the paste station and the wrapping station have not been illustrated for the sake of simplifying the drawings.

Feed arrangement 500 includes a mounting frame 506 on which three transfer wheels 508, 510, 512 are mounted for rotation about respective axes which are substantially parallel to each other and which are located at the apexes of a triangle. Each wheel has a plurality of axially-extending grooves, such as groove 511 in FIG. 25, spaced equi-distantly over the circumference thereof. A plurality of supports 513 on frame 506 are operative to journal opposite ends of rotary worm screws 514, 516, 518. Screws 514, 516, 518 extend between wheels 508 and 510; 510 and 512; and 512 and 508, respectively, to thereby lie in a generally triangular configuration.

Both screws 514, 516 have a uniform helical thread over their entire lengths and each of these screws have the same pitch. Screw 518, on the other hand, has three helically threaded portions over its length, threaded end portions 518*a*, 518*b* having the same pitch as screws 514 or 516. The pitch of intermediate threaded portion 518*c* is greater than that of the end portions.

A guide member 522 has a cam track 524 formed therein. The path of the cam track 524 is diagrammatically illustrated in FIG. 23 by dashed lines and identified generally by reference numeral 525.

A plurality of platen assemblies 529–539 are advanced along path 525 by the feed arrangement 500. Each assembly is supported for movement along path 525 by a support rod mounted on each assembly and by a cam roller mounted at the far end of the support rod. As shown in FIG. 24, cam roller 542 is mounted on support rod 540 of the assembly 538, and roller 542 is receivable in sliding engagement with the cam track 524.

In order to advance the platen assemblies along path 525, each assembly is provided with a transport element such as rod 550 of generally circular cross section. Transport rod 550 is receivable between each pair of raised threaded portions of each worm screw.

In operation, each worm screw and wheel is driven about their respective axes. As screw 514 is rotated about its longitudinal axis, assemblies 529–531 are each advanced at a predetermined rate of speed lengthwise of screw 514 towards the wheel 510. At the very end of screw 514, the transport rod 550 is simultaneously located in the last space between the last two raised threaded portions and in the groove 552 of the wheel 510. Now, the wheel 510 takes over and advances each platen assembly towards the screw 516.

The platen assemblies 533–535 travel along screw 516 at the same predetermined rate of speed and in the same manner as previously described for screw 514. Transfer of each platen assembly to wheel 512 and onto threaded end portion 518*a* proceeds exactly as described before.

Once a platen assembly is advanced beyond screw end portion 518*a*, the platen assembly is moved through a much larger distance per unit revolution of the screw 518, as compared to the distance per unit revolution of the other screws. This means that the spacing of the platen assemblies on screw 518 is longer than the spacing of successive platen assemblies advancing along screw 514 or screw 516. Moreover, such platen assembly on the threaded intermediate portion 518*c* is conveyed to the wrapping drum 504 at a correspondingly faster advancement speed, as compared to the advancement speed of the assemblies on either of the aforementioned screws 514 or 516. This means that the relatively wider spacing between the wrappers on the carrier drum 502 has been converted to a relatively closer spacing between the wrappers on the wrapping drum 504. In short, the relative spacing between the wrappers on the drum 502 has been decreased in order to meet the optimum wrapping distance requirements of the wrapping station associated with drum 504.

In reciprocal manner, the pitch of the worm screws 514, 516 and on the end portions 518*a*, 518*b* of the worm screw 518 can be made larger than the pitch on the intermediate worm screw portion 518*c*. In this case, the spacing between the wrappers on the drum 504 would be larger than the spacing between the wrappers on the cutting drum 502. Thus, by controlling the pitch ratios of the various screws in the feed arrangement 500, one can respace the wrappers to any desired spacing.

It will be understood that each of the elements described above, or two or more together, may also find a useful application in other types of construction differing from the types described above.

While the invention has been illustrated and described as embodied in Feed Arrangement for and Method of Continuously Feeding Cigar Wrappers to Cigar Wrapping Stations of Cigar Wrapping Machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In an apparatus for wrapping elongated cigar wrappers, each having a tuck end and a flag end, around elongated cigar bunches including means for conveying cigar wrappers along a first feed path; means for conveying cigar bunches transversely along a second feed path converging with said first path at a wrapping section where said paths generally match each other; said bunch conveying means including a plurality of independently driven, conveyed nests; means for applying an adhesive onto said tuck ends of said wrappers as they move along said first path toward said wrapping section, the improvement comprising: means for lifting said adhesive carrying tuck ends of said wrappers into engagement with said bunches in said wrapping section and preparatory to wrapping by rotating said bunches.

2. The improvement as defined in claim 1 wherein said first path is generally circular.

3. The improvement as defined in claim 1 wherein said lifting means includes elements on said wrapper conveying means and below said tuck ends and means for forcing one of said elements toward one of said nests as a wrapper and nest supported bunch converge at said wrapping section.

4. The improvement as defined in claim 1 wherein said wrappers have a known shape and said wrapper conveying means includes a plurality of spaced segments each including vacuum surfaces having a shape generally matching said known shape for capturing one of said wrappers and said lifting means includes a lift means movable through said surfaces for lifting the tuck ends of one of said wrappers.

5. The improvement as defined in claim 4 wherein two of said wrappers are supported on each of said vacuum surfaces with said tuck ends abutting and wherein said lift means includes a member for lifting said abutting tuck ends in unison.

* * * * *